US008507416B2

(12) United States Patent
Hatasaki et al.

(10) Patent No.: US 8,507,416 B2
(45) Date of Patent: Aug. 13, 2013

(54) WATER-BASED LUBRICANT FOR PLASTIC PROCESSING HAVING EXCELLENT CORROSION RESISTANCE AND METAL MATERIAL HAVING EXCELLENT PLASTIC PROCESSABILITY

(75) Inventors: Kosuke Hatasaki, Tokyo (JP); Masumi Hara, Tokyo (JP); Atsushi Serita, Tokyo (JP); Takeshi Fujikawa, Tokyo (JP); Masanobu Tanaka, Tokyo (JP)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/316,687

(22) Filed: Dec. 12, 2011

(65) Prior Publication Data

US 2012/0083432 A1 Apr. 5, 2012

Related U.S. Application Data

(63) Continuation of application No. PCT/JP2010/004256, filed on Jun. 28, 2010.

(30) Foreign Application Priority Data

Jun. 29, 2009 (JP) ..... 2009-153494

(51) Int. Cl.
*C10M 173/02* (2006.01)
*C08G 73/00* (2006.01)

(52) U.S. Cl.
USPC ..... 508/176

(58) Field of Classification Search
USPC ..... 508/176
See application file for complete search history.

(56) References Cited

U.S. PATENT DOCUMENTS

| | | | | |
|---|---|---|---|---|
| 2005/0075253 | A1* | 4/2005 | Uda et al. | 508/454 |
| 2007/0105727 | A1* | 5/2007 | Doi et al. | 508/167 |

FOREIGN PATENT DOCUMENTS

| | | | |
|---|---|---|---|
| JP | 5955791 | A | 3/1984 |
| JP | 6158085 | | 6/1994 |
| JP | 6158085 | A | 6/1994 |
| JP | 200063880 | A | 2/2000 |
| JP | 3227721 | B2 | 11/2001 |
| JP | 3285962 | | 3/2002 |
| JP | 2002265974 | A | 9/2002 |
| JP | 2002361302 | | 12/2002 |
| JP | 2002361302 | A | 12/2002 |
| JP | 2003306689 | | 10/2003 |

(Continued)

OTHER PUBLICATIONS

International Search Report for PCT/JP2010/004256, dated Sep. 28, 2010, 3 pages.

*Primary Examiner* — Cephia D Toomer
*Assistant Examiner* — Vishal Vasisth
(74) *Attorney, Agent, or Firm* — Mary K. Cameron

(57) ABSTRACT

To provide a water-based lubricant for plastic working excellent in moisture absorption resistance and corrosion resistance, with which degradation in lubricating performances such as lubricity, workability and seizure resistance may not occur even under high-temperature/high humidity environments.

A water-based lubricant for plastic working, comprising a resin component containing a copolymer or homopolymer of monomers having an ethylenically unsaturated bond, including at least maleic anhydride (A), an inorganic component (B), and a solid lubricating component (C), wherein maleic anhydride moieties of the resin component (A) are blocked with a nitrogen-containing compound at a blocking ratio of 10 to 80%, and unblocked maleic anhydride moieties are neutralized with an alkaline component at a degree of neutralization of 40 to 100%.

22 Claims, 1 Drawing Sheet

(56) References Cited

FOREIGN PATENT DOCUMENTS

| | | | |
|---|---|---|---|
| JP | 2003306689 | A | 10/2003 |
| JP | 200499949 | A | 4/2004 |
| JP | 2004099949 | | 4/2004 |
| JP | 2004292565 | | 10/2004 |
| JP | 2004292565 | A | 10/2004 |
| JP | 3881129 | | 11/2006 |
| JP | 3984159 | | 7/2007 |
| JP | 2007176962 | | 7/2007 |
| JP | 2007176962 | A | 7/2007 |
| WO | 03035929 | A1 | 5/2003 |
| WO | WO03035929 | | 5/2003 |
| WO | 2005095564 | A1 | 10/2005 |
| WO | WO2005095564 | | 10/2005 |

* cited by examiner

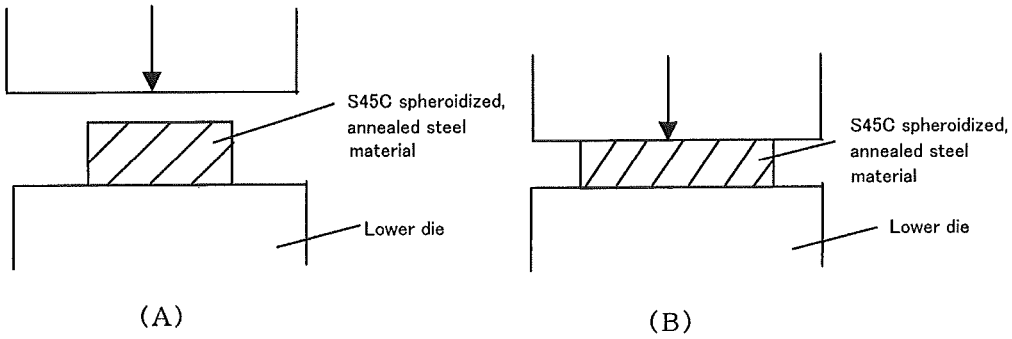
S45C spheroidized, annealed steel material
Lower die
(A)
S45C spheroidized, annealed steel material
Lower die
(B)

WATER-BASED LUBRICANT FOR PLASTIC PROCESSING HAVING EXCELLENT CORROSION RESISTANCE AND METAL MATERIAL HAVING EXCELLENT PLASTIC PROCESSABILITY

This application is a CON of PCT/JP2010/004256, filed Jun. 28, 2010.

TECHNICAL FIELD

The present invention relates to lubricants for plastic working to be used for the purpose of imparting corrosion resistance to surfaces of various metallic materials such as iron and steel, stainless steel, aluminum and aluminum alloys, titanium and titanium alloys, copper and copper alloys and magnesium and magnesium alloys in plastic working at cold regions such as forging, wire drawing, tube drawing, roll forming and pressing and to metallic materials having surfaces over which films are formed by applying and drying such lubricants. To describe the technical field in more detail, water-based lubricants for plastic working are generally formulated with water-soluble components as lubricant components, such as water-soluble inorganic salts and water-soluble polymers. Since these components have high affinity with water and are poorly water-resistant, under high-temperature/high-humidity environments, water vapor in the atmosphere will infiltrate into lubricating films and reach metal surfaces to cause rusting. As such, the present invention relates to water-based lubricants for plastic working having high corrosion resistance even under high-temperature/high-humidity environments and to metallic materials having surfaces over which films are formed of such lubricants.

BACKGROUND ART

In plastic working typified by forging, wire drawing, tube drawing, roll forming, pressing and the like, friction that is caused when metal surfaces (especially, of dies and works) intensively rub with each other may cause an increase in working energy, heat generation, seizure phenomenon and the like, for which various lubricants have been used with intent to reduce the frictional force. Traditionally, oils and soaps have been used as lubricants and fed to frictional surfaces as fluid lubricating films to reduce the frictional force. However, they involve large heat generation due to enlargement of surface area and are insufficient in lubricity for plastic working in which sliding occurs under high contact pressure, allowing seizure to more easily occur due to a break in the lubricating films and so on. Therefor, a technique has been generalized and widely used, in which metallic material surfaces are coated in advance with inorganic films such as borax films and crystallized phosphate films or solid films such as resin films with sufficient film strength, which intervene at interfaces between dies and works even under high contact pressure so that a break in the lubricating films may not easily occur and the direct contact between metals may be avoided.

On the other hand, requirements for solid films are widely ranging and being rapidly increased in recent years, including a further reduction of working energy, an increase in intense working, adaptation to refractory works, environmental friendliness of filming processes (for example, phosphating produces a large amount of industrial waste such as sludge, causing problems in environmental conservation) and adaptation to lubricating powder-free or oil-free working. To address these requirements while considering environmental conservation, solid films having a high degree of lubricity are being developed. The technique forms films having a high degree of lubricity through a convenient step of applying a water-based lubricant for plastic working to surfaces of works and drying the lubricant. As such a technique, a lubricant composition for plastic working of metallic materials, containing (A) a synthetic resin, (B) a water-soluble inorganic salt and water, wherein (B)/(A) (mass ratio of solid content) is from 0.25/1 to 9/1 and the synthetic resin is dissolved or dispersed is disclosed in Patent Reference 1. It is also described in Patent Reference 1 that it is preferred to incorporate 1 to 20% by mass of at least one selected from the group consisting of a metallic soap, a wax, polytetrafluoroethylene and an oil as a lubricating component and that at least one selected from the group consisting of a sulfate, a borate, a molybdate, a vanadate and a tungstate is preferred as the water-soluble inorganic salt. This technique is an excellent one in which a lubricating film is formed of lubricating components such as a soap and wax being bound in a solid film consisting of (A) the synthetic resin and (B) the water-soluble inorganic salt and the lubricating film is coated on a surface of a work to obtain a lubricating film having a high degree of workability in a convenient and power-saving manner. This technique is widely used mainly in the field of plastic working and is a promising technique because techniques excellent even in intense working applications, which have a greater surface area extension in comparison with the combination of industrially established phosphate films and soaps, are being developed.

Patent Reference 1: Japanese Patent No. 3881129

Also, a water-based lubricant for plastic working of metallic materials as a composition containing (A) at least one water-soluble inorganic salt selected from the group consisting of a sulfate, a silicate, a borate, a molybdate and a tungstate and (B) a wax, dissolved or dispersed in water optionally with a surface active agent, wherein the mass ratio of solid content (B)/(A) is within the range of 0.3 to 1.5 is disclosed in Patent Reference 2. This technique is an excellent one in which a water-soluble inorganic salt is used as a principal component of a solid film and a lubricating wax is incorporated in the solid film to provide a high degree of working performance, similarly to Patent Reference 1.

Patent Reference 2: Japanese Patent No. 3984159

As stated in Patent References 1 and 2, water-soluble inorganic salts and water-soluble resins are essential components of solid films of water-based lubricants for plastic working, because lubricating films composed of water-soluble inorganic salts and/or water-soluble resins have sufficient film strength and, as mentioned above, intervene at interfaces between dies and works even under high contact pressure so that a break in the lubricating films may not easily occur and direct contact between metals may be avoided. For water-based lubricants for plastic working, therefore, the combination of solid films composed of water-soluble inorganic salts and/or water-soluble resins with appropriate slip additives capable of reducing coefficient of friction allows to maintain good lubricating conditions during plastic working.

The mechanism of film forming of water-based lubricants for plastic working composed of water-soluble components will be described. Water-soluble inorganic salts and water-soluble resins as the water-soluble components are dissolved or dispersed in water in lubricant treatment liquids and, when the lubricants are applied to metallic material surfaces followed by drying, water as solvent will evaporate so that lubricating films may be formed. In the meantime, the water-soluble inorganic salts and the water-soluble resins will deposit as solids on the metallic material surfaces to form solid films. The solid films thus formed possess sufficient film strength to withstand plastic working and, with suitable slip additives incorporated for reducing coefficient of friction, exhibit good lubricity during plastic working.

However, the water-soluble components have deliquescency and/or hygroscopicity because of water solubility, and therefore, the solid films formed over the metallic material surfaces will absorb moisture by absorbing water vapor in the atmosphere under high-temperature/high-humidity environments. Through moisture absorption, the solid films will be swollen with or dissolved in water, gradually turning from solid to fluid. When the solid films fluidize, the film strength will markedly decrease, causing a break in the lubricating films at the interface between dies and works under high contact pressure during plastic working and allowing direct contact between metals to occur. Therefore, lubricants for plastic working whose solid films are composed of water-soluble components such as water-soluble inorganic salts and water-soluble resins absorb moisture under high-temperature/high-humidity environments to greatly reduce their lubricity, workability and seizure resistance.

Also, since water-soluble components absorb water, which can be a corrosion medium for metals, through moisture absorption, rust will be produced on metallic material surfaces. When rust is produced, it will not only deteriorate the appearance but also degrade the dimensional accuracy at worked surfaces. In plastic working, it is important that a metallic material is shaped exactly to the shape of a die when pressed, with qualities higher when dimensions are more accurate and forged surface textures are smoother. Therefore, rust produced before press working increases frictional force to thereby reduce lubricity, leading to the degradation of dimensional accuracy and/or the deterioration of forged surface textures through the indentation of the rust at the worked surfaces. Also, rust produced after press working increases the surface roughness at worked surfaces, leading to the degradation of dimensional accuracy and the deterioration of forged surface textures.

As mentioned above, lubricating films composed of water-soluble components absorb moisture under high-temperature/high-humidity environments to cause the degradation of lubricating performance and rusting. Therefore, it is difficult to store metallic materials over which lubricating films are formed in exposure to the atmosphere for an extended period of time. If a lubricated metallic material was placed in a hermetically sealed container with a moisture-proof agent introduced to suppress moisture absorption, storage for an extended period of time would be possible; at production sites, however, mass production and mass storage are made in most cases, and such a method of storage would be industrially impractical.

On the other hand, in phosphating typified by bonderizing, chemical conversion reaction occurs on the surface of a work to deposit a crystalline phosphate. A phosphate is water-insoluble and will not absorb moisture even under high-temperature/high-humidity environments. Therefore, the lubricating performance will not degrade and, with excellent corrosion resistance, the degradation of dimensional accuracy or the deterioration of forged surface textures due to rusting will not occur. Therefore, storage even under high-temperature/high-humidity environments for an extended period of time is possible, without concern of the effects of moisture absorption and rusting. However, phosphating produces a large amount of industrial waste such as sludge in film treatment, causing problems in environmental conservation.

Also, in-line systems have been put into practical use, which continuously carry out the steps from formation of a lubricating film to press working, as a countermeasure for preventing moisture absorption. According to this method, since press working is made before moisture absorption, the effects of moisture absorption on a lubricating film may be ignored, and simultaneously, productivity can conveniently be improved. According to such systems, however, the lubricating film will absorb moisture in cases where, for example, an extended period of line shutdown occurs due to some necessity in production such as troubles and/or maintenance. When the lubricating film has a film temperature higher than the outside air temperature due to the preheating at a drying step, the moisture in the film will tend to evaporate and no moisture absorption will occur, but when the temperature drops to the outside air temperature, moisture absorption will start. In any case, the moisture absorption by the lubricating film may not be avoided under the environment where the film temperature drops to the outside air temperature.

Water-soluble inorganic salts and synthetic resins are generally used in solid films of water-based lubricants for plastic working and, among the wide variety of such synthetic resins, there are components that are less susceptible to moisture absorption in comparison with the water-soluble inorganic salts. Specifically, among the synthetic resins described in Patent Reference 1, acrylic resins, vinyl acetate resins, epoxy resins, urethane resins and phenolic resins may be mentioned. These synthetic resins have less hydrophilic groups responsible for moisture absorption in their structures, with less affinity with water, and therefore, are excellent in water resistance and less susceptible to performance degradation due to moisture absorption. However, these synthetic resins are dispersed as particles in the water-based lubricants and, when the water-based lubricants are heated in use for the purpose of accelerating drying of the lubricating films, the particles will flocculate each other to immediately deteriorate the dispersed state. Since the water-soluble inorganic salts exist as ions in the water-based lubricants, they can be used as heated at below 80° C. with no problems in liquid stability. Therefore, the synthetic resins are inferior in dispersion stability in the water-based lubricants to the water-soluble inorganic salts.

Furthermore, while such synthetic resins are excellent in water resistance, they are poor in film removal, causing various failures during subsequent steps. It is a concern that, if film removal is insufficient, for example, film components may contaminate a cutting coolant during a cutting step after the press working and, for a case of gear parts, they may contaminate a lubricating oil after assembly into transport equipment. Also, when plating is carried out after a film removal step, film components may not only contaminate the plating solution but also cause plating failures at portion where the film components remain.

For film removal, a lubricant composition for forming lubricating films removable by water rinsing, with use of a synthetic resin excellent in film removal properties as a solid film, is described in Patent Reference 3. This technique is a lubricant composition for forming lubricating films removable by water rinsing, comprising (a) at least one selected from water-soluble polyesters having an average molecular weight of 30,000 to less than 500,000 and water-soluble polysaccharides, (b) at least one selected from water-soluble polyamides, (c) at least one selected from waxes having a melting point of 50 to 130° C. and (d) water, wherein the weight ratio of (a)/(b) is 50/1 to 1/50, and the content of (c) is 3 to 90 parts by weight based on 100 parts by weight of the sum of (a) and (b). However, the solid film of this lubricant is mainly based on a synthetic resin, with no incorporated components for improving film strength such as water-soluble inorganic salts. Therefore, it does not have sufficient film strength for plastic working, allowing a break in the film under high contact pressure and causing seizure with dies. Such a lubricant is therefore insufficient in performance under stringent working conditions.

Patent Reference 3: Japanese Patent No. 3285962

Therefore, water-based lubricants for plastic working composed of water-soluble components, with which no degradation of lubricity or seizure resistance will occur by moisture absorption even under high-temperature/high-humidity environments and which are excellent in corrosion resistance so that the degradation of dimensional accuracy or the deterioration of forged surface textures due to rusting on the worked surfaces may not occur, have not yet been obtained. In addition, water-based lubricants that can be used while heated and provide easy film removal have not yet been obtained.

In another aspect, since the water-based lubricants for plastic working in Patent References 1 and 2 have high affinity with water and low water resistance, they will allow, under high-temperature/high-humidity environments, water vapor in the atmosphere to infiltrate into lubricating films and reach metallic material surfaces to produce rust. When rust is produced, it will not only deteriorate the appearance but also degrade the dimensional accuracy at worked surfaces. In plastic working, it is important that a metallic material is shaped exactly to the shape of a die when pressed, with qualities higher when dimensions are more accurate and forged surface textures are smoother. Therefore, rust produced before press working increases frictional force to thereby reduce lubricity, leading to the degradation of dimensional accuracy and/or the deterioration of forged surface textures through the indentation of the rust at the worked surfaces. Also, rust produced after press working increases the surface roughness at the worked surfaces, leading to the degradation of dimensional accuracy and the deterioration of forged surface textures.

On the other hand, in phosphating typified by bonderizing, chemical conversion reaction occurs on the surface of a work to deposit a crystalline phosphate. A phosphate is water-insoluble and has high water resistance, and therefore, is excellent in corrosion resistance, so that the degradation of dimensional accuracy or the deterioration of forged surface textures due to rusting will not occur. Therefore, storage even under high-temperature/high-humidity environments for an extended period of time is possible, without concern of the effects of rusting. However, phosphating produces a large amount of industrial waste such as sludge in film treatment, causing problems in environmental conservation.

Water-soluble inorganic salts and synthetic resins are generally used in solid films of water-based, lubricating film treatment agents for plastic working and, among the wide variety of such synthetic resins, there are components that are more water-resistant than the water-soluble inorganic salts. Specifically, among the resins described in Patent Reference 1, acrylic resins, vinyl acetate resins, epoxy resins, urethane resins and phenolic resins may be mentioned. These resins have less hydrophilic groups in their structures, with less affinity with water, and therefore, are high in water resistance and exhibit excellent corrosion resistance. When plastic forming is carried out, however, these synthetic resins are poor in conformability to metallic material surfaces during material deformation, reducing remaining films with the result that sufficient corrosion resistance may not be obtained.

Therefore, water-based lubricants for plastic working composed of water-soluble inorganic salts or synthetic resins as principal components, which are excellent in corrosion resistance under high-temperature/high-humidity environments and with which no degradation of dimensional accuracy or no deterioration of forged surface textures due to rusting at worked surfaces may occur, have not yet been obtained.

SUMMARY OF THE INVENTION

Problems to be Solved by the Invention

The present invention has an object to provide water-based lubricants for plastic working that are excellent in corrosion resistance even under high-temperature/high humidity environments.

Means for Solving the Problems

The present invention (1) is a water-based lubricant for plastic working, comprising a resin component containing a copolymer or homopolymer of monomers having an ethylenically unsaturated bond, including at least maleic anhydride (A), an inorganic component (B), and a solid lubricating component (C), wherein maleic anhydride moieties of the resin component (A) are blocked with a nitrogen-containing compound at a blocking ratio of 10 to 80%, and unblocked maleic anhydride moieties are neutralized with an alkaline component at a degree of neutralization of 40 to 100%.

The present invention (2) is the water-based lubricant for plastic working according to the invention (1) wherein the nitrogen-containing compound is ammonia.

The present invention (3) is the water-based lubricant for plastic working according to the invention (1) or (2) wherein the monomers having an ethylenically unsaturated bond comprise isobutylene and/or styrene.

The present invention (4) is the water-based lubricant for plastic working according any one of the inventions (1) to (3) wherein a ratio of maleic anhydride to the total monomers is 30 to 70% by mole in the resin component (A).

The present invention (5) is the water-based lubricant for plastic working according any one of the inventions (1) to (4) wherein the alkaline component of the resin component (A) is at least one selected from sodium hydroxide, potassium hydroxide and ammonia.

The present inventions (6) to (10) are characterized by that an inorganic reinforcing component ($B_1$) is selected as the inorganic component (B). Films formed with conventional lubricants tend to absorb water vapor in the atmosphere under high-temperature/high humidity environments because water-soluble components are more or less deliquescent and/or hygroscopic and have strong affinity with water. Therefore, lubricating films composed of water-soluble components suffer from the degradation of lubricating performances such as lubricity, workability and seizure resistance due to moisture absorption during plastic working. Furthermore, the lubricating films will absorb water, which can be a corrosion medium, through moisture absorption to allow rusting. Therefore, the present inventions (6) to (10) have an object to provide water-based lubricants for plastic working, with which no degradation of lubricity, workability and seizure resistance due to moisture absorption will occur even under high-temperature/high humidity environments and which are rust-preventive and excellent in moisture absorption resistance and corrosion resistance; and metallic materials having surfaces over which films are formed.

The present invention (6) is the water-based lubricant for plastic working according to any one of the inventions (1) to (5) wherein the inorganic component (B) is an inorganic reinforcing component ($B_1$).

The present invention (7) is the water-based lubricant for plastic working according to the invention (6) wherein the resin component (A), the inorganic reinforcing component ($B_1$) and the solid lubricating component (C) have a solid content by mass in the range of:

$$[(A)+(B_1)]/[(A)+(B_1)+(C)]=0.2 \text{ to } 0.97$$

$$(A)/(B_1)=0.35 \text{ to } 3.85.$$

The present invention (8) is the water-based lubricant for plastic working according to the invention (6) or (7) wherein the inorganic reinforcing component ($B_1$) has a Mohs hardness of 1 to 5.

The present invention (9) is the water-based lubricant for plastic working according to any one of the inventions (6) to (8) wherein the inorganic reinforcing component ($B_1$) has a particle size of 0.1 to 10 μm.

The present invention (10) is the water-based lubricant for plastic working according to any one of the inventions (6) to (9) wherein the inorganic reinforcing component ($B_1$) is at least one selected from the group consisting of basic magnesium carbonate, calcium carbonate, basic zinc carbonate, magnesium hydroxide, calcium hydroxide, talc, mica, calcium phosphate, zinc phosphate and aluminum dihydrogen tripolyphosphate.

The present inventions (11) to (13) are characterized by that a water-soluble inorganic component ($B_2$) is selected as the inorganic component (B). Since films formed with conventional lubricants have strong affinity with water as a component and are low in water resistance, they will allow, under high-temperature/high humidity environments, water vapor in the atmosphere to infiltrate into lubricating films and reach metal surfaces to produce rust. As such, the present inventions (11) to (13) have an object to provide water-based lubricants for plastic working which are rust-preventive even under high-temperature/high humidity environments and metallic materials having surfaces over which films are formed, by combining a resin component (A) and a water-soluble inorganic component ($B_2$).

The present invention (11) is the water-based lubricant for plastic working according to any one of the inventions (1) to (5) wherein the inorganic component (B) is at least one water-soluble inorganic component ($B_2$) selected from the group consisting of a borate, a silicate, a vanadate, a molybdate and a tungstate.

The present invention (12) is the water-based lubricant for plastic working according to the invention (11) wherein the water-soluble inorganic component ($B_2$) is at least one selected from a molybdate and a tungstate.

The present invention (13) is the water-based lubricant for plastic working according to the invention (11) or (12) wherein the resin component (A), the water-soluble inorganic component ($B_2$) and the solid lubricating component (C) have a solid content by mass in the range of:

$$[(A)+(B_2)]/[(A)+(B_2)+(C)]=0.2 \text{ to } 0.97$$

$$(A)/(B_2)=0.2 \text{ to } 8.$$

The present invention (14) is the water-based lubricant for plastic working according to any one of the inventions (1) to (13) further containing a rust-preventive additive component (D), whose ratio by mass is 0.01 to 0.1 based on the total solid content.

The present invention (15) is the water-based lubricant for plastic working according to the invention (14) wherein the rust-preventive additive component (D) is at least one selected from a nitrite, a phosphate, an amine, an azole, a permanganate, a peroxide, a carbonate, a zirconium compound, a calcium compound, a magnesium compound, a zinc compound and a bismuth compound.

The present invention (16) is the water-based lubricant for plastic working according to any one of the inventions (1) to (15) wherein the solid lubricating component (C) is at least one selected from the group consisting of a wax, polytetrafluoroethylene, a fatty acid and a salt thereof, a fatty amide, molybdenum disulfide, tungsten disulfide, graphite, melamine cyanurate, organically treated synthetic mica, and an amino acid compound having a layered structure.

The present invention (17) is a metallic material, excellent in plastic workability, comprising a surface over which a films is formed by applying and drying the water-based lubricant for plastic working according to any one of the inventions (1) to (16).

BRIEF DESCRIPTION OF THE DRAWINGS

FIG. 1 is a drawing illustrating a method of an indoor exposure test after working.

BEST MODE FOR CARRYING OUT THE INVENTION

A water-based lubricant for plastic working according to the present invention comprises a resin component containing a copolymer or homopolymer of monomers having an ethylenically unsaturated bond, including at least maleic anhydride (A), an inorganic component (B) and a solid lubricating component (C) wherein maleic anhydride moieties of the resin component (A) are blocked with a nitrogen-containing compound at a blocking ratio of 10 to 80%, and unblocked maleic anhydride moieties are neutralized with an alkaline component at a degree of neutralization of 40 to 100%. First, components, compositions and the like of the water-based lubricant for plastic working according to the present invention will be described.

<<Components>>

{Component (A)}

Composing Monomers

The resin component (A) [macromolecular material (A)] comprises a copolymer or homopolymer of monomers having an ethylenically unsaturated bond, including at least maleic anhydride. Thus, the copolymer or homopolymer has maleic anhydride moieties in the structure and can be dissolved or dispersed in water upon neutralization by an alkaline component. Therefore, the resin component (A) is dissolved or dispersed in a lubricating liquid using water as a solvent. When the lubricating liquid is applied on a metallic material surface and dried to evaporate water, the resin component (A) will be deposited on the metallic material surface, during which the maleic anhydride moieties will form a solid bond with the material surface to provide good adhesion. Also, the maleic anhydride moieties of the resin component (A) tend to adhere and solidly bind to the particle surfaces of the inorganic reinforcing component ($B_1$) so that the resin component (A) may be an excellent binder for the inorganic reinforcing component ($B_1$). Therefore, the resin component (A) in combination with the inorganic reinforcing component ($B_1$) will function as a particularly preferable film former for lubricating films.

Here, "monomers containing an ethylenically unsaturated bond" besides maleic anhydride may preferably include α-olefins (for example, isobutylene), styrene and vinyl esters (for example, vinyl acetate). A particularly preferred resin component (A) is a copolymer of isobutylene and maleic anhydride or of styrene and maleic anhydride, which has a structure in which isobutylene or styrene and maleic anhydride are alternately arranged in monomer units or monomer blocks.

The ratio of maleic anhydride based on the total monomers in the copolymer of the resin component (A) is preferably 30 to 70% by mole. While the molar ratio of isobutylene or styrene to maleic anhydride in a molecule, mentioned above as a preferred embodiment, is preferably 1 to 1, it will not be limited thereto as long as solubilization or dispersion in water is possible and adhesion of material surfaces is obtained.

Blocking

The copolymer of the resin component (A) is characterized by that the maleic anhydride moieties are blocked by a nitrogen-containing compound at a blocking ratio of 10 to 80% (preferably 30 to 60%). Here, a blocking ratio is defined as the number of moles of maleic anhydride blocked by blocking treatment based on the total number of 100 moles of maleic anhydride of the copolymer or homopolymer of the resin component (A). Procedures for blocking may include imidation of the maleic anhydride moieties and metallization by reacting maleic anhydride with an alkaline earth metal, such as calcium or magnesium, an amphoteric metal such as zinc, aluminum, tin or lead or a transition metal such as chromium, nickel, manganese, iron or copper. Among them, imidation of the maleic anhydride moieties is preferred and cyclization by imidation is more preferred. Blocking of maleic anhydride moieties of the resin component (A) may impart hydrophobicity to those moieties. Therefore, imidation of maleic anhydride moieties can suppress absorption of water vapor at those moieties so that the moisture absorption resistance of lubricating films may be improved. Here, moisture absorption resistance means that lubricating films will not have degraded lubricity or seizure resistance even under high-humidity environments. Also, blocked maleic anhydride moieties tend to adhere to metals. Therefore, imidated maleic anhydride functions as an inhibitor to metallic material surfaces to improve corrosion resistance of lubricating films. If the imidation ratio is too high, the ratio of maleic anhydride that can be ring-opened by neutralization with an alkaline component will be lower, with the result that dissolution or dispersion in water may be impossible. Also, if the imidation ratio is too low, the effects of moisture absorption resistance and corrosion resistance may not sufficiently be obtained. When the imidation ratio is below 10%, the moisture absorption resistance and the corrosion resistance will be insufficient, and when the ratio is over 80%, solubilization in water may not be made. Therefore, the imidation ratio is 10 to 80% (preferably 30 to 60%). Here, as nitrogen-containing compounds for imidation, ammonia and primary amines in general may be mentioned without limitation, ammonia being preferred. Examples of primary amines may include primary amines having alkyl groups with 1 to 3 carbon atoms, such as methylamine, ethylamine, n-propylamine and i-propylamine.

Neutralization

The copolymer or homopolymer of the resin component (A) is characterized by that the unblocked maleic anhydride moieties are neutralized with an alkaline component at a degree of neutralization (degree of alkaline neutralization) of 40 to 100%. Here, a degree of neutralization is defined as the number of moles of maleic anhydride neutralized with an alkaline component based on the total number of 100 moles of unblocked maleic anhydride of the copolymer of the resin component (A). The neutralization of maleic anhydride requires 2 moles of sodium hydroxide in relation to 1 mole of maleic anhydride in a case that the alkaline component is sodium hydroxide. Thus, when the maleic anhydride moieties present in the structure of the copolymer or homopolymer are neutralized with an alkaline component, the maleic anhydride moieties will be ring-opened, with the result that the copolymer or homopolymer may be dissolved or dispersed in water. Here, when the degree of neutralization is low, the added amount of an alkaline component, which may cause moisture absorption, may be reduced so that the moisture absorption resistance of lubricating films may be improved, but when the degree of neutralization is below 40%, the resin component (A) may be not solubilized in water, to be less dispersed in the lubricant. The degree of neutralization is more preferably 40 to 80%.

Alkaline components are not particularly limited, as long as they can ring-open the maleic anhydride moieties to solubilize the resin component (A) in water. Specific examples of alkaline components may include sodium hydroxide, potassium hydroxide, ammonia, triethylamine, triethanolamine and diethanolamine and so on. These may be used alone or in combination of two or more. Sodium hydroxide, potassium hydroxide and ammonia are more preferred.

The resin component (A) is characterized by that the maleic anhydride moieties are moderately blocked by a nitrogen-containing compound, and optionally, unblocked maleic anhydride moieties may be partially esterified by well-known means. By such means, the maleic anhydride moieties will be turned into hydrophobic alcohol ester groups and hydrophilic carboxyl groups, resulting in further imparting hydrophobicity, in addition to blocking. Also, the carboxyl groups may be neutralized by an alkaline component to be soluble in water.

Molecular Weight

The copolymer or homopolymer of the resin component (A) preferably has a weight-average molecular weight of 5,000 to 400,000. When the molecular weight is too high, the lubricant treatment liquid will have an excessively high viscosity, which prevents a good coated appearance from being obtained and impairs drying of the lubricant. Conversely, when the molecular weight is too low, the film strength may be insufficient for plastic working.

{Component (B)}

As the inorganic component (B), an inorganic reinforcing component ($B_1$) or a water-soluble inorganic component ($B_2$) may be used. Here, depending on whether the inorganic reinforcing component ($B_1$) or the water-soluble inorganic component (B2) is selected, the actions and effects of the water-based lubricant for plastic working will differ. The inorganic reinforcing component ($B_1$) may be used in combination with the water-soluble inorganic component ($B_2$).

That is, when the inorganic reinforcing component ($B_1$) is selected, water absorption properties will decrease due to the inclusion of the inorganic reinforcing component. Thereby, films formed with the lubricant for plastic working will be less water-absorbing, so that films with high corrosion resistance may be obtained even under high-temperature/high-humidity environments. On the other hand, when the water-soluble inorganic component ($B_2$) is selected, films obtained by applying the lubricant for plastic working will have high conformability to treated metallic materials, so that films with high corrosion resistance may be obtained. The inorganic components (B) will be described in detail below.

Inorganic Reinforcing Component ($B_1$)

Materials

The inorganic reinforcing component ($B_1$) is insoluble or hardly soluble in water and is, unlike water-soluble inorganic salts, dispersed with particle shape in the water-based lubricant without being completely dissolved. Here, "insoluble or hardly soluble" as used herein refers to a solubility of 130 mg or less in 100 g of water at 20° C. The inorganic reinforcing component ($B_1$) is of particles very low in solubility in water, and has low affinity with water to be less moisture-absorptive. Therefore, the inorganic reinforcing component ($B_1$) is required in properties to improve the film strength of solid films as a reinforcing agent for the resin component (A) and not to absorb moisture. Also, the inorganic reinforcing component ($B_1$) preferably has a Mohs hardness of 1 to 5. When the Mohs hardness is smaller than 1, the reinforcing effect of the resin component (A) will be insufficient, and when the Mohs hardness is greater than 5, the particles are so hard that they may intensely wear out the surfaces of molding dies. Specific examples of such inorganic reinforcing components ($B_1$) may include basic magnesium carbonate, calcium carbonate, basic zinc carbonate, magnesium hydroxide, calcium hydroxide, talc, mica, calcium phosphate, zinc phosphate and aluminum dihydrogen tripolyphosphate. These may be used alone or in combination of two or more.

Particle Size

The inorganic reinforcing component ($B_1$) preferably has a particle size of 0.1 to 10 μm. Here, a "particle size" refers to an average particle size (median diameter d50) that is a value measured with, for example, a particle size distribution analyzer by HORIBA, Ltd. (Model LA-920, particle size standard: volume). In the water-based lubricant for plastic working according to the present invention, solid films formed by the combination of the inorganic reinforcing component ($B_1$) and the resin component (A) may provide good lubricity and moisture absorption resistance. In order to combine these two components, it is necessary to adjust the particle size of the inorganic particles ($B_1$) to the size close to the film thickness of the resin component (A). When the particle size of the inorganic reinforcing component ($B_1$) is greater than 10 μm, that is, too great in relation to the film thickness of the resin component (A), the particles will protrude beyond the polymer film and the combination will be insufficient. On the other hand, when the particle size is smaller than 0.1 μm, combining will be sufficient, but it will take a large amount of time and cost to finely grind the inorganic reinforcing component ($B_1$) causing an economic disadvantage. Therefore, the particle size of the inorganic reinforcing component ($B_1$) is more preferably 5 μm or smaller, and even more preferably, 2 μm or smaller.

Water-Soluble Inorganic Component ($B_2$)

The water-soluble inorganic component ($B_2$) has the function of improving the film strength of a lubricating film and improving the film conformability to a metallic material surface during plastic deformation, through interaction with the resin component (A). Here, "water-soluble" in the present Specification refers to a solubility of 130 mg or more in 100 g of water at 20° C. Furthermore, the water-soluble inorganic component ($B_2$) has the function, of adjusting the pH of the water-based lubricating film treatment agent in a range where corrosion reaction of the metallic material may not occur, or of forming an oxidized film over the metallic material surface and therefore, exhibits excellent corrosion resistance through synergistic effects with the resin component (A) with high water resistance. Examples of water-soluble inorganic components ($B_2$) having such functions may include borates, silicates, vanadates, molybdates and tungstates. These may be used alone or in combination of two or more. Particularly preferred are molybdates and tungstates for forming oxidized films.

Here, specific examples of borates of the water-soluble inorganic components ($B_2$) may include sodium borates (sodium tetraborate and the like), potassium borates (potassium tetraborate and the like) and ammonium borates (ammonium tetraborate and the like). Specific examples of silicates may include sodium silicate, potassium silicate and ammonium silicate. Specific examples of vanadates may include sodium vanadate, sodium metavanadate, potassium vanadate and potassium metavanadate. Specific examples of molybdates may include sodium molybdate and potassium molybdate. Specific examples of tungstates may include sodium tungstate and potassium tungstate.

{Component (C)}

Materials

The solid lubricating component (C) is soft and slippery itself and has the function of reducing frictional force between dies and works during plastic working. While an increase in frictional force during plastic working causes an increase in working energy, heat generation and seizure, the solid lubricating component (C), as incorporated in the water-based lubricant for plastic working according to the present invention, will exist as a solid form in the lubricating film to suppress the increase in frictional force. Also, the solid lubricating component (C) is of particles insoluble or hardly soluble in water and is not moisture-absorptive. Examples of solid lubricating components having such functions and properties may include waxes, polytetrafluoroethylene, fatty acids and salts thereof, fatty amides, molybdenum disulfide, tungsten disulfide, graphite, melamine cyanurate, organically treated synthetic mica, and amino acid compounds having a layered structure. These may be used alone or in combination of two or more.

Here, specific examples of waxes for the solid lubricating components (C) may include polyethylene wax, paraffin wax, microcrystalline wax, polypropylene wax and carnauba wax. Specific examples of fatty acids and salts thereof may include myristic acid, palmitic acid, stearic acid, sodium myristate, potassium myristate, sodium palmitate, potassium palmitate, sodium stearate, potassium stearate, calcium stearate, zinc stearate, barium stearate, magnesium stearate and lithium stearate. Fatty amides are amide compounds having two fatty acids, specific examples of which may include ethylenebis-lauric acid amide, ethylenebis-stearic acid amide, ethylenebis-behenic acid amide, N—N'-distearyladipic acid amide, ethylenebis-oleic acid amide, ethylenebis-erucic acid amide, hexamethylenebis-oleic acid amide and N—N'-dioleyladipic acid amide.

The organically treated synthetic mica of the solid lubricating component (C) is made by introducing an organic modifier between layers of a synthetic mica having a layered structure. The synthetic mica is called host and the organic modifier introduced between layers is called guest. An organic treatment is carried out according to a method in which the guest is introduced while the host is swollen with water to expand the distance between layers. A specific example of synthetic mica which has a swelling property with water may be sodium tetrasilicic mica. The guest is a primary to tertiary alkylamine or alkyl quaternary ammonium salt that is adsorbed between layers to form a solid bond, specific examples of which may include stearyl dimethylamine, distearyl amine, distearyl dimethylamine, stearyl trimethylammonium chloride and distearyl dimethylammonium chloride.

An amino acid compound having a layered structure of the solid lubricating component (C) is an amino acid or a derivative thereof having a hydrocarbon group with 11 or more carbon atoms in the molecular structure. A specific example may be N-lauroyl-L-lysine [$C_{11}H_{23}CONH(CH_2)_4CH(NH_2)COOH$].

{Other Components}

{Rust-Preventive Additive Component (D)}

While the water-based lubricant according to the present invention exhibits excellent corrosion resistance by the combination of the blocking (for example, imidation) of the resin component (A) and the inorganic component (B), a rust-preventive additive component (D) may be incorporated for the purpose of further improving corrosion resistance. The rust-preventive additive component (D) to be used here is a corrosion inhibitor for inhibiting rusting on metallic materials and is a component acting as an inhibitor for suppressing redox reaction on metal surfaces. The rust-preventive additive component (D) can be incorporated to such a degree that it may not reduce the lubricity of the water-based lubricating film treatment agent, preferably in a mass ratio of 0.01 to 0.1 based on the total solid content.

Here, examples of rust-preventive additive components (D) may include nitrites, phosphates, amines, azoles, permanganates, peroxides, carbonates, zirconium compounds, calcium compounds, magnesium compounds, zinc compounds and bismuth compounds. Specific examples of nitrites may include sodium nitrite and potassium nitrite. Specific examples of phosphates may include sodium dihydrogen phosphate, disodium hydrogen phosphate, trisodium phosphate, sodium hypophosphite, sodium hypophosphite, potassium dihydrogen phosphate, dipotassium hydrogen phosphate, tripotassium phosphate, sodium pyrophosphate, potassium pyrophosphate, sodium tripolyphosphate, potassium tripolyphosphate, potassium phosphite, potassium hypophosphite, calcium phosphite, zinc phosphite, aluminum phosphite, magnesium phosphite, aluminum orthophosphate, aluminum metaphosphate and titanium hydrogen phosphate. Specific examples of amines may include diethanolamine and triethanolamine. Specific examples of azoles may include benzotriazole, methyl benzotriazole, 1-hydroxy benzotriazole, aminotriazole and aminotetrazole. Examples of permanganates may include sodium permanganate and potassium permanganate. A specific example of a peroxide may be hydrogen peroxide. Specific examples of carbonates may include sodium carbonate and potassium carbonate. Specific examples of zirconium compounds may include water-dispersible zirconium oxide colloid, zirconium hydroxide, zirconium oxycarbonate, basic zirconium carbonate, zirconium potassium carbonate, zirconium ammonium carbonate, zirconium silicate, zirconium phosphate, zirconium titanate, zirconium tungstate, lithium zirconate, aluminum zirconate and magnesium zirconate. Specific examples of calcium compounds may include basic calcium molybdate, calcium silicate and calcium tetraborate. A specific example of a magnesium compound may be magnesium silicate. A specific example of a zinc compound may be basic zinc molybdate. An example of a bismuth compound may be bismuth orthovanadate. These may be used alone or in combination of two or more.

When a surface active agent is necessary to disperse the solid lubricating component (C) in the water-based lubricant, a nonionic, anionic, amphoteric or cationic surface active agent can be used. Examples of nonionic surface active agents may include, without limitation, polyoxyethylene alkyl ethers, polyoxyethylene alkyl ethers, polyoxyalkylene (ethylene and/or propylene) alkyl phenyl ethers, polyoxyethylene sorbitan alkylesters that are composed of polyethylene glycol (or ethylene oxide) and a higher fatty acid (for example, having 12 to 18 carbon atoms) and so on. Examples of anionic surface active agents may include, without limitation, fatty acid salts, sulfate ester salts, sulphonate salts, phosphate ester salts, dithiophosphate ester salts and so on. Examples of amphoteric surface active agents may include, without limitation, amino acid-type and betaine-type carboxylate salts, sulfate ester salts, sulphonate salts, phosphate ester salts and so on. Examples of cationic surface active agents may include, without limitation, aliphatic amine salts, quaternary ammonium salts and so on. These surface active agents may be used alone or in combination of two or more. Added amounts are preferably 5% or less based on the total solid content by mass. When they are added at 5% or more, it will cause a reduction in strength of formed lubricating films.

{Liquid Medium}

The liquid medium (solvent, dispersion medium) for the water-based lubricant for plastic working according to the present invention is water. An alcohol having a boiling point lower than water may be incorporated for reducing drying time of the lubricant during drying step.

<<Composition>>

Next, the composition of the water-based lubricant for plastic working according to the present invention will be described. Here, the composition of the water-based lubricant for plastic working has preferred composition ratios that will differ depending on whether the inorganic component (B) is an inorganic reinforcing component ($B_1$) or a water-soluble inorganic component ($B_2$).

When it is an inorganic reinforcing component ($B_1$), the water-based lubricant for plastic working has a solid content by mass of the resin component (A), the inorganic reinforcing component ($B_1$) and the solid lubricating component (C) preferably in the range of:

$$[(A)+(B_1)]/[(A)+(B_1)+(C)]=0.2 \text{ to } 0.97$$

$$(A)/(B_1)=0.35 \text{ to } 3.85,$$

and more preferably in the range of:

$$[(A)+(B_1)]/[(A)+(B_1)+(C)]=0.5 \text{ to } 0.90$$

$$(A)/(B_1)=0.5 \text{ to } 2.91.$$

As mentioned above, the resin component (A) is a film former for lubricating films and the inorganic reinforcing component ($B_1$) is an reinforcing agent for the resin component (A) and the combination of these two components allows a more robust, solid films to be formed. Here, when $[(A)+(B_1)]/[(A)+(B_1)+(C)]$ is less than 0.2, the relative amount of the solid film will be small, with the result that seizure due to a break in the film may easily occur under high contact pressure during working and when it is greater than 0.97, the solid lubricating component (C) will be insufficient, which may increase frictional force. Also, when $(A)/(B_1)$ is less than 0.35, the inorganic reinforcing component ($B_1$) will be excessive in relation to the resin component (A) with the result that the inorganic reinforcing component ($B_1$) may not be retained in addition to that adhesion with materials may not be obtained, and when it is greater than 3.85, the inorganic reinforcing component ($B_1$) will be insufficient, which prevents a sufficient strength for the solid film from being obtained.

Next, when it is a water-soluble inorganic component ($B_2$), the water-based lubricant for plastic working has a solid content by mass of the resin component (A), the water-soluble inorganic component ($B_2$) and the solid lubricating component (C) preferably in the range of:

$$[(A)+(B_2)]/[(A)+(B_2)+(C)]=0.2 \text{ to } 0.97$$

$$(A)/(B_2)=0.2 \text{ to } 8,$$

and more preferably in the range of:

$$[(A)+(B_2)]/[(A)+(B_2)+(C)]=0.5 \text{ to } 0.9$$

$$(A)/(B_2)=0.5 \text{ to } 6.$$

As mentioned above, due to synergistic effects with the resin component (A), the resin component (A) and the water-soluble inorganic component ($B_2$) will form a robust, solid film excellent in film conformability to metallic material surfaces during plastic deformation and excellent in corrosion resistance. Here, when $[(A)+(B_2)]/[(A)+(B_2)+(C)]$ is less than 0.2, the relative amount of the solid film will be small, with the result that seizure due to a break in the film may easily occur under high contact pressure during working and when it is greater than 0.97, the solid lubricating component (C) will be insufficient, which may increase frictional force. Also, when $(A)/(B_2)$ is less than 0.2, the water-soluble inorganic component $(B_2)$ will be excessive in relation to the resin component (A) to reduce the water resistance of the lubricating film with the result that corrosion resistance may not be obtained, and when it is greater than 8, the water-soluble inorganic component $(B_2)$ will be insufficient, which prevents a sufficient strength or film conformability for the solid film from being obtained.

<<Process for Production>>

A water-based lubricant for plastic working according to the present invention is produced by admixing a resin component (A), an inorganic component (B) and a solid lubricating component (C) to water as a liquid medium. Here, since an inorganic reinforcing component $(B_1)$ and the solid lubricating component (C) are of particles insoluble or hardly soluble in water, such particles are needed to be dispersed in the lubricant. Dispersion is carried out according to a method in which a surface active agent capable of functioning as a dispersant is added to and made sufficiently miscible with water and then desired particles are added while stirring is continued until uniform dispersion is obtained. Example of stirring methods may include propeller stirring and stirring with a homogenizer that has higher shearing force compared to a propeller. Wet grinders such as ball mills and sand mills may be used with media such as zirconia, titania and zirconia beads to grind particles to reduce the primary particle size for dispersion. While the resin component (A) has maleic anhydride moieties in its structure, which act to adhere to particle surfaces, so that it may function as a superior dispersant, known surface active agents may also be used in order to provide more stably dispersed state. Such surface active agents are not limited in kind or structure as long as moisture absorption resistance or corrosion resistance may not be impaired. Also, surface active agents functioning as anti-foaming agents may be added when dispersions tend to foam. Here, as a surface active agent, a nonionic, anionic, amphoteric, cationic or high-molecular surface active agent can be used. Examples of nonionic surface active agents may include, without limitation, polyoxyethylene alkyl ethers, polyoxyalkylene (ethylene and/or propylene) alkyl phenyl ethers, polyoxyethylene alkylesters that are composed of polyethylene glycol (or ethylene oxide) and a higher fatty acid (for example, having 12 to 18 carbon atoms) and polyoxyethylene sorbitan alkylesters that are composed of sorbitan, polyethylene glycol and a higher fatty acid (for example, having 12 to 18 carbon atoms) and so on. Examples of anionic surface active agents may include, without limitation, fatty acid salts, sulfate ester salts, sulphonate salts, phosphate ester salts, dithiophosphate esters and so on. Examples of amphoteric surface active agents may include, without limitation, amino acid-type and betaine-type carboxylate salts, sulfate ester salts, sulphonate salts, phosphate ester salts and so on. Examples of cationic surface active agents may include, without limitation, aliphatic amine salts, quaternary ammonium salts and so on. Examples of high-molecular surface active agents may include those of a weight-average molecular weight approximately from several hundreds to one hundred thousand, having, for example, acrylic acid, methacrylic acid, sulphonic acid, maleic acid, cellulose, chitosan, polyester, polyurethane, polyamine or an alcohol in the structure. These surface active agents may be used alone or in combination of two or more.

<<Method of Use>>

{Objects of Application}

The water-based lubricant for plastic working according to the present invention is applied to metallic materials such as iron or steel, stainless steel, copper or copper alloys, aluminum or aluminum alloys, and titanium or titanium alloys and so on. Shapes of metallic materials may include, without limitation, bar stocks and blocks as wells as forged shapes such as gears and shafts.

{Method of Application}

Next, a method of application of the water-based lubricant for plastic working according to the present invention will be described. The method of application includes a step of cleaning a metallic material, a step of applying the water-based lubricant for plastic working and a step of drying. Each step will be described below.

Step of Cleaning (Step of Pretreatment)

Before contacting a metallic material to the water-based lubricant for plastic working, it is preferred to carry out at least one cleaning treatment selected from the group consisting of shot blasting, sand blasting, peeling, alkaline degreasing and acid pickling. Cleaning here is intended to remove oxidized scales built up through annealing and/or various stains (such as oil).

Step of Application

The step of applying the water-based lubricant according to the present invention to a metallic material is not particularly limited, for which immersion, flow coating, spraying and the like can be used. Application to such an degree that the surface may be covered with the water-based lubricant according to the present invention is sufficient, with no limitation on the period of time of application. Here, the metallic material may be warmed to 60 to 80° C. in order to increase the ease of drying, before contacting with the water-based lubricant for plastic working. Also, a water-based lubricant for plastic working warmed to 40 to 70° C. may be contacted. In this way, the ease of drying may be greatly improved so that drying at normal temperature may be possible in some cases, and the loss of thermal energy may be reduced.

Step of Drying

The water-based lubricant for plastic working needs to be dried after application. Drying may be carried by leaving at normal temperature or may be carried out at 60 to 150° C. for 1 to 30 minutes.

Here, the amount of deposition of a lubricating film to be formed over a metal surface is appropriately controlled depending on the degree of subsequent working and is preferably in the range of 0.5 to 40 $g/m^2$ and more preferably in the range of 2 to 20 $g/m^2$. When the amount of deposition is less than 0.5 $g/m^2$, lubricity will be insufficient. Also, when the amount of deposition is greater than 40 $g/m^2$, clogging of dies with foreign matter and the like will unfavorably occur, although lubricity will not be affected. The amount of deposition can be calculated based on the difference in weight of a metallic material before and after the treatment and the surface area. In order to control the amount of deposition to be within the range mentioned above, the solid content by weight (concentration) of the water-based lubricant may appropriately be adjusted. Practically, highly concentrated lubricants are often diluted to be used. While water for diluting is not particularly limited, deionized water and distilled water are preferred.

{Method of Film Removal}

A lubricating film formed with the water-based lubricant for plastic working according to the present invention can be removed by immersion in or spraying with a water-based alkaline cleaning agent. An alkaline cleaning agent is a liquid of a general alkaline component such as sodium hydroxide or potassium hydroxide being dissolved in water. When the lubricating film is contacted with the cleaning agent, maleic anhydride moieties of hydrophilic groups of the resin component (A) will be hydrolyzed to be dissolved in the cleaning liquid so that the film may easily be removed. Through alkaline cleaning, therefore, contamination and/or plating failures at subsequent stages due to insufficient film removal may be avoided.

EXAMPLES

The present invention and the effects thereof will be more specifically described below, with reference to Examples and Comparative Examples for cases in which inorganic reinforcing components ($B_1$) are used as inorganic components (B). The present invention is not to be limited by these Examples.

(1-1) Production of Water-Based Lubricants for Plastic Working

The components listed below were used in combinations and ratios shown in Table 1 to prepare water-based lubricants of Examples 1 to 23 and Comparative Examples 1 to 7. The weight ratio of the total solid content to water in each of the water-based lubricants was 1.5 to 8.5. Also, imidation of the resin component (A) was carried out according to the method described in Japanese Unexamined Patent Publication No. 59-55791 using ammonia in all cases. Comparative Example 8 refers to a phosphate/soap treatment.

<Resin Component (A)

(A)-1 Isobutylene/maleic anhydride (molecular weight 60,000)
Ratio of maleic anhydride: 50%
Imidation ratio: 50%
Neutralizing component: potassium hydroxide
Degree of neutralization: 60%

(A)-2 Isobutylene/maleic anhydride (molecular weight 90,000)
Ratio of maleic anhydride: 50%
Imidation ratio: 30%
Neutralizing component: sodium hydroxide
Degree of neutralization: 40%

(A)-3 Isobutylene/maleic anhydride (molecular weight 90,000)
Ratio of maleic anhydride: 50%
Imidation ratio: 60%
Neutralizing component: sodium hydroxide
Degree of neutralization: 80%

(A)-4 Isobutylene/maleic anhydride (molecular weight 300,000)
Ratio of maleic anhydride: 70%
Imidation ratio: 80%
Neutralizing component: ammonia
Degree of neutralization: 100%

(A)-5 Isobutylene/maleic anhydride (molecular weight 60,000)
Ratio of maleic anhydride: 50%
Imidation ratio: 10%
Unblocked maleic anhydride being partially esterified with methanol
Neutralizing component: potassium hydroxide
Degree of neutralization: 60%

(A)-6 Styrene/maleic anhydride (molecular weight 350,000)
Ratio of maleic anhydride: 30%
Imidation ratio: 10%
Neutralizing component: potassium hydroxide
Degree of neutralization: 50%

(A)-7 Styrene/maleic anhydride (molecular weight 350,000)
Ratio of maleic anhydride: 30%
Imidation ratio: 0%
Neutralizing component: potassium hydroxide
Degree of neutralization: 60%

(A)-8 Isobutylene/maleic anhydride (molecular weight 90,000)
Ratio of maleic anhydride: 50%
Imidation ratio: 50%
Neutralizing component: ammonia
Degree of neutralization: 30%

<Inorganic Reinforcing Component (B 1)>

(B1)-1 Calcium hydroxide $Ca(OH)_2$, Mohs hardness 4.5, particle size 2 μm (B1)-2 Calcium carbonate $CaCO_3$, Mohs hardness 3, particle size 5 μm (B1)-3 Magnesium hydroxide $Mg(OH)_2$, Mohs hardness 2.5, particle size 1 μm (B1)-4 Mica (synthetic mica), Mohs hardness 2, particle size 2 μm (B1)-5 Basic magnesium carbonate, Mohs hardness 3, $4MgCO_3.Mg(OH)_2.4H_2O$, particle size 1 μm (B1)-6 Calcium phosphate $[Ca_3(PO_4)_2]_3.Ca(OH)_2$, Mohs hardness 5, particle size 1 μm (B1)-7 Zinc phosphate $Zn_3.(PO_4)_2.4H_2O$, Mohs hardness 3, particle size 0.6 μm (B1)-8 Ammonium dihydrogen tripolyphosphate, Mohs hardness 3, particle size 2.7 μm (B1)-9 Talc $3MgO.4SiO_2.H_2O$, Mohs hardness 1, particle size 1.5 μm (B1)-10 Calcium hydroxide $Ca(OH)_2$, Mohs hardness 4.5, particle size 20 μm <Solid Lubricating Component (C)>

(C)-1 Paraffin wax
(C)-2 Polyethylene wax
(C)-3 Polytetrafluoroethylene
(C)-4 Calcium stearate
(C)-5 Molybdenum disulfide
(C)-6 Ethylenebis-stearic acid amide
(C)-7 Tungsten disulfide
(C)-8 Graphite
(C)-9 Melamine cyanurate
(C)-10 Nε-lauroyl-L-lysine $[C_{11}H_{23}CONH(CH_2)_4CH(NH_2)COOH]$ <Rust-Preventive Additive Component (D)>

(D1)-1 Zinc phosphite
(D1)-2 Magnesium phosphite
(D1)-3 Zirconium potassium carbonate <Water-Soluble Solid Film> Comparative Examples 6 and 7

Sodium tetraborate, Mohs hardness 2.5, water-soluble inorganic salt
Water-based urethane resin, dispersed in water (1-2) Pretreatment and Film Treatment (1-2-1) Film Treatment for Cold Forging Test Test strips for evaluation: S45C spheroidized, annealed steel material 25 mm ϕ×30 mm Pretreatment and Film Treatment of Examples 1 to 23 and Comparative Examples 1 to 7

(a) Degreasing: Commercially available degreasing agent (FINECLEANER 4360, manufactured by Nihon Parkerizing Co., Ltd.), concentration 20 g/L, temperature 60° C., immersion 10 minutes (b) Water rinsing: tap water, ordinary temperature, immersion 30 seconds (c) Lubricating film treatment: water-based lubricant produced in (1), temperature 60° C., immersion 1 minute (d) Drying: 100° C., 10 minutes (e) Dry film weight: 10 g/m$^2$ Pretreatment and Film Treatment of Comparative Example 8 (Phosphate/Soap Treatment)

(a) Degreasing: Commercially available degreasing agent (FINECLEANER 4360, manufactured by Nihon Parkerizing Co., Ltd.), concentration 20 g/L, temperature 60° C., immersion 10 minutes (b) Water rinsing: tap water, ordinary temperature, immersion 30 seconds (c) Acid pickling: hydrochloric acid, concentration 17.5%, ordinary temperature, immersion 10 minutes (d) Chemical conversion treatment: commercially available zinc phosphate chemical conversion treatment agent (PALBOND 181X, manufactured by Nihon Parkerizing Co., Ltd.), concentration 90 g/L, temperature 80° C., immersion 10 minutes (e) Water rinsing: tap water, ordinary temperature, immersion 30 seconds (f) Soap treatment: commercially available reactive soap lubricant (PALUBE 235, manufactured by Nihon Parkerizing Co., Ltd.), concentration 70 g/L, temperature 85° C., immersion 3 minutes (g) Drying: 100° C., 10 minutes (h) Dry film weight: 10 g/m$^2$ (1-2-2) Film Treatment for Corrosion Resistance Evaluation Test Test strips for evaluation: Cold-rolled steel sheets (SPCC-SD) 150 mm×70 mm×0.8 mmt Pretreatment and Film Treatment of Examples 1 to 23 and Comparative Examples 1 to 7

(a) Degreasing: commercially available degreasing agent (FINECLEANER 4360, manufactured by Nihon Parkerizing Co., Ltd.), concentration 20 g/L, temperature 60° C., immersion 10 minutes (b) Water rinsing: tap water, ordinary temperature, immersion 30 seconds (c) Lubricating film treatment: water-based lubricant produced in (1), temperature 60° C., immersion 1 minute (d) Drying: 100° C., 10 minutes (e) Dry film weight: 5 g/m$^2$ Pretreatment and Film Treatment of Comparative Example 8 (Phosphate/Soap Treatment)

(a) Degreasing: commercially available degreasing agent (FINECLEANER 4360, manufactured by Nihon Parkerizing Co., Ltd.), concentration 20 g/L, temperature 60° C., immersion 10 minutes (b) Water rinsing: tap water, ordinary temperature, immersion 30 seconds (c) Acid pickling: hydrochloric acid, concentration 17.5%, ordinary temperature, immersion 10 minutes (d) Chemical conversion treatment: commercially available zinc phosphate chemical conversion treatment agent (PALBOND 181X, manufactured by Nihon Parkerizing Co., Ltd.), concentration 90 g/L, temperature 80° C., immersion 10 minutes (e) Water rinsing: tap water, ordinary temperature, immersion 30 seconds (f) Soap treatment: commercially available reactive soap lubricant (PALUBE 235, manufactured by Nihon Parkerizing Co., Ltd.), concentration 70 g/L, temperature 85° C., immersion 3 minutes (g) Drying: 100° C., 10 minutes (h) Dry film weight: 10 g/m$^2$ (1-3) Evaluation Test (1-3-1) Cold Forging Test Lubricity and seizure resistance of lubricating films under high-humidity environments were evaluated according to a cold forging test. On simulating a high-temperature/high-humidity environment where moisture absorption occurs during summertime, the test strips film-treated in (1-2) were placed in a temperature and humidity-controlled bath at an air temperature of 30° C. and a relative humidity of 70% and left standing for 70 hours. The test strips were then withdrawn for forging test. For cold forging test, spike test working was carried out according to the invention of Japanese Patent No. 3227721 to measure the maximum load (kNf) and spike height (mm) during working to evaluate lubricity. Also, seizure at worked surfaces of the test strips was observed to evaluate seizure resistance.

Evaluation Standards

Lubricity

Spike performance=spike height (mm)/working load (kNf)×100

Greater value, better lubricity

●: 0.95 or greater

○: 0.94 to less than 0.95

Δ: 0.90 to less than 0.94 x: less than 0.90

Seizure Resistance

Seizure at worked surfaces

○: no seizure

Δ: slight seizure x: heavy seizure (1-3-2) Film Removal Evaluation Test

Film removal of lubricating films after cold forging test was evaluated. Ratio of film remaining was calculated by immersing the test strips after cold forging test in the following alkaline cleaning agent to measure the film weights before and after the film removal treatment.

Alkaline cleaning agent: 2% aqueous NaOH solution

Conditions for film removal treatment: liquid temperature 60° C., immersion time 3 minutes Method of Treatment Film weight measurement before film-removing treatment→film-removing treatment→water rinsing→drying→film weight measurement after film-removing treatment Ratio of film remaining (%)=(film weight after film-removing treatment/film weight before film-removing treatment)×100

Evaluation Standards

Lower ratio of film remaining, better film removal

○: ratio of film remaining less than 3%

Δ: ratio of film remaining less than 10% x: ratio of film remaining 10% or more (1-3-3) Corrosion Resistance Evaluation Test 1

The test strips film-treated in (1-2) were exposed indoors in an open atmosphere during summertime for one month to observe rusting.

Evaluation Standards

●: no rusting

○: very slight rusting (rusted area less than 3% based on test strip's surface area)

Δ: slight rusting (rusted area 3% to less than 10% based on test strip's surface area)

x: heavy rusting (rusted area 30% or more based on test strip's surface area)

The results of the testing described above are shown in Table 2. As apparent from Table 2, Examples 1 to 23 using the water-based lubricant for plastic working according to the present invention exhibit excellent lubricity and seizure resistance, and are excellent in both film removal and corrosion resistance. On the other hand, Comparative Example 1 is inferior in corrosion resistance because the maleic anhydride of the resin component (A) is not imidated. For Comparative Example 2, the degree of neutralization of the resin component (A) is too low for the component to be dispersed in water, preventing a formulation from being manufactured. Comparative Example 3 does not contain the resin component (A), and therefore, suffers from poor formation of the lubricating film and adhesion to the material, with inferior lubricity, seizure resistance and corrosion resistance. Comparative Example 4 does not contain the inorganic reinforcing component ($B_1$), with the result that the lubricating film may not have sufficient strength, allowing seizure to occur, with inferior lubricity and seizure resistance. Comparative Example 5 is inferior in lubricity because it does not contain the solid lubricating component (C). For Comparative Example 6, while the solid film was made of sodium tetraborate (borax) as a water-soluble inorganic salt, it is inferior in lubricity, seizure resistance and corrosion resistance because it absorbs moisture. For Comparative Example 7, while the solid film was made of a water-based urethane resin, it lacks film strength, with an inferior seizure resistance and film removal. For Comparative Example 8 wherein the phosphate film was treated with a reactive soap, while excellent lubricity is exhibited, effluent treatment and/or fluid management will be required, with the result that convenient process steps or devices may not be used, and waste associated with the reaction will be produced to increase environmental burden.

The present invention and the effects thereof will be more specifically described below, with reference to Examples and Comparative Examples for cases in which water-soluble inorganic components ($B_2$) are used as inorganic components (B). The present invention is not to be limited by these Examples.

(2-1) Production of Water-Based Lubricating Film Treatment Agents

The components listed below were used in combinations and ratios shown in Table 1 to prepare water-based lubricants of Examples 24 to 57 and Comparative Examples 9 to 14. The weight ratio of the total solid content to water in each of the water-based lubricants was 1.5 to 8.5. Also, imidation of the resin component (A) was carried out according to the method described in Japanese Unexamined Patent Publication No. SHO 59-55791 using ammonia in all cases. Comparative Example 14 refers to a phosphate/soap treatment.

<Resin Component (A)>

(A)-1 Isobutylene/maleic anhydride (molecular weight 60,000)

Ratio of maleic anhydride: 50%

Imidation ratio: 50%

Neutralizing component: potassium hydroxide

Degree of neutralization: 60%

(A)-2 Isobutylene/maleic anhydride (molecular weight 90,000)

Ratio of maleic anhydride: 50%

Imidation ratio: 30%

Neutralizing component: sodium hydroxide

Degree of neutralization: 40%

(A)-3 Isobutylene/maleic anhydride (molecular weight 90,000)

Ratio of maleic anhydride: 50%

Imidation ratio: 60%

Neutralizing component: sodium hydroxide

Degree of neutralization: 80%

(A)-4 Isobutylene/maleic anhydride (molecular weight 300,000)

Ratio of maleic anhydride: 70%

Imidation ratio: 80%

Neutralizing component: ammonia

Degree of neutralization: 100%

(A)-5 Isobutylene/maleic anhydride (molecular weight 60,000)

Ratio of maleic anhydride: 50%

Imidation ratio: 50%

Unblocked maleic anhydride being partially esterified with methanol

Neutralizing component: potassium hydroxide

Degree of neutralization: 60%

(A)-6 Styrene/maleic anhydride (molecular weight 350,000)

Ratio of maleic anhydride: 30%

Imidation ratio: 10%

Neutralizing component: potassium hydroxide

Degree of neutralization: 50%

(A)-7 Styrene/maleic anhydride (molecular weight 350,000)

Ratio of maleic anhydride: 30%

Imidation ratio: 0%

Neutralizing component: potassium hydroxide

Degree of neutralization: 60%

(A)-8 Isobutylene/maleic anhydride (molecular weight 90,000)

Ratio of maleic anhydride: 50%

Imidation ratio: 50%

Neutralizing component: ammonia

Degree of neutralization: 30%

<Water-soluble Inorganic Component (B2)>

(B2)-1 Sodium tetraborate (B2)-2 Potassium tetraborate (B2)-3 Sodium silicate (B2)-4 Potassium silicate (B2)-5 Sodium vanadate (B2)-6 Potassium metavanadate (B2)-7 Sodium molybdate (B2)-8 Potassium molybdate (B2)-9 Sodium tungstate (B2)-10 Potassium tungstate <Solid Lubricating Component (C)>

(C)-1 Paraffin wax (C)-2 Polyethylene wax (C)-3 Polytetrafluoroethylene (C)-4 Calcium stearate (C)-5 Molybdenum disulfide (C)-6 Ethylenebis-stearic acid amide (C)-7 Tungsten disulfide (C)-8 Graphite (C)-9 Melamine cyanurate (C)-10 NE-lauroyl-L-lysine [$C_{11}H_{23}CONH(CH_2)_4CH(NH_2)COOH$]

<Rust-Preventive Additive Component (D2)>

(D2)-1 Sodium nitrite (D2)-2 Tripotassium phosphate (D2)-3 Sodium tripolyphosphate (D2)-4 Potassium phosphite
(D2)-5 Diethanolamine
(D2)-6 1-Hydroxybenzotriazole
(D2)-7 Aminotetrazole
(D2)-8 Potassium permanganate
(D2)-9 Hydrogen peroxide water
(2-2) Pretreatment and Film Treatment
(2-2-1) Film Treatment for Cold Forging Test
Test strips for evaluation: S45C spheroidized, annealed steel material 25 mm ϕ×30 mm Pretreatment and Film Treatment of Examples 24 to 57 and Comparative Examples 9 to 13

(a) Degreasing: Commercially available degreasing agent (FINECLEANER 4360, manufactured by Nihon Parkerizing Co., Ltd.), concentration 20 g/L, temperature 60° C., immersion 10 minutes
(b) Water rinsing: tap water, ordinary temperature, immersion 30 seconds
(c) Lubricating film treatment: water-based lubricating film treatment agent produced in (1), temperature 60° C., immersion 1 minute
(d) Drying: 100° C., 10 minutes
(e) Dry film weight: 10 g/m$^2$ Pretreatment and Film Treatment of Comparative Example 14 (Phosphate/Soap Treatment)

(a) Degreasing: Commercially available degreasing agent (FINECLEANER 4360, manufactured by Nihon Parkerizing Co., Ltd.), concentration 20 g/L, temperature 60° C., immersion 10 minutes
(b) Water rinsing: tap water, ordinary temperature, immersion 30 seconds
(c) Acid pickling: hydrochloric acid, concentration 17.5%, ordinary temperature, immersion 10 minutes
(d) Chemical conversion treatment: commercially available zinc phosphate chemical conversion treatment agent (PALBOND 181X, manufactured by Nihon Parkerizing Co., Ltd.), concentration 90 g/L, temperature 80° C., immersion 10 minutes
(e) Water rinsing: tap water, ordinary temperature, immersion 30 seconds
(f) Soap treatment: commercially available reactive soap lubricant (PALUBE 235, manufactured by Nihon Parkerizing Co., Ltd.), concentration 70 g/L, temperature 85° C., immersion 3 minutes
(g) Drying: 100° C., 10 minutes
(h) Dry film weight: 10 g/m$^2$
(2-2-2) Film Treatment for Corrosion Resistance Evaluation Test
Test strips for evaluation: Cold-rolled steel sheets (SPCC-SD) 150 mm×70 mm×0.8 mmt
S45C spheroidized, annealed steel material 30 mm ϕ×10 mm Pretreatment and Film Treatment of Examples 24 to 57 and Comparative Examples 9 to 13

(a) Degreasing: commercially available degreasing agent (FINECLEANER 4360, manufactured by Nihon Parkerizing Co., Ltd.), concentration 20 g/L, temperature 60° C., immersion 10 minutes
(b) Water rinsing: tap water, ordinary temperature, immersion 30 seconds
(c) Lubricating film treatment: water-based lubricating film treatment agent produced in (1), temperature 60° C., immersion 1 minute
(d) Drying: 100° C., 10 minutes
(e) Dry film weight: 10 g/m$^2$ Pretreatment and Film Treatment of Comparative Example 14 (Phosphate/Soap Treatment)

(a) Degreasing: commercially available degreasing agent (FINECLEANER 4360, manufactured by Nihon Parkerizing Co., Ltd.), concentration 20 g/L, temperature 60° C., immersion 10 minutes
(b) Water rinsing: tap water, ordinary temperature, immersion 30 seconds
(c) Acid pickling: hydrochloric acid, concentration 17.5%, ordinary temperature, immersion 10 minutes
(d) Chemical conversion treatment: commercially available zinc phosphate chemical conversion treatment agent (PALBOND 181X, manufactured by Nihon Parkerizing Co., Ltd.), concentration 90 g/L, temperature 80° C., immersion 10 minutes
(e) Water rinsing: tap water, ordinary temperature, immersion 30 seconds
(f) Soap treatment: commercially available reactive soap lubricant (PALUBE 235, manufactured by Nihon Parkerizing Co., Ltd.), concentration 70 g/L, temperature 85° C., immersion 3 minutes
(g) Drying: 100° C., 10 minutes
(h) Dry film weight: 10 g/m$^2$
(2-3) Evaluation Test
(2-3-1) Cold Forging Test
Cold forging test was carried out on the test strips film-treated in (2-2-1) to evaluate lubricity and seizure resistance of the lubricating films. For the cold forging test, spike test working was carried out according to the invention of Japanese Patent No. 3227721 to measure the maximum load (kNf) and spike height (mm) during working to evaluate lubricity. Also, seizure at worked surfaces of the test strips was observed to evaluate seizure resistance.
Evaluation Standards
Lubricity Spike test performance=spike height (mm)/working load (kNf)×100

Greater value, better lubricity
Excellent: 0.95 or greater
Good: 0.94 to less than 0.95
Acceptable: 0.90 to less than 0.94
Unacceptable: less than 0.90
Seizure Resistance
Seizure at worked surfaces
Excellent: no seizure, with no metallic luster
Acceptable: no seizure, with metallic luster
Unacceptable: seizure observed
(2-3-2) Corrosion Resistance Test
<Indoor Exposure Test>
The cold-rolled steel sheets film-treated in (2-2-2) were exposed indoors in an open atmosphere during summertime for one month to observe rusting. The ratios of rusting in Table refer to proportions in area of rusting produced on the surfaces of the test strips.
<High-temperature Humidity Cabinet Test>
The cold-rolled steel sheets film-treated in (2-2-2) were left in a temperature and humidity-controlled bath conditioned at 50° C. and 80% RH for two weeks to observe rusting.

<Dew Condensation Test>

The cold-rolled steel sheets film-treated in (2-2-2) were left in a temperature-controlled bath conditioned at −10° C. for one hour and then in a temperature and humidity-controlled bath conditioned at 40° C. and 70% RH for 23 hours. This cycle was repeated five times to observe rusting.

<Indoor Exposure Test After Working>

Refer to FIG. 1. The S45C spheroidized, annealed steel material film-treated in (2-2-2) was placed on a lower die having a flat surface as shown in FIG. 1(A) and then upset with a load of a 200 ton clamp press for forming as shown in FIG. 1(B). Meanwhile, the lower die was adjusted in height so that the test strip had a height of 10 mm to 6 mm and working was made at a compressibility of 40%. After press working, the test strip was exposed indoors in an open atmosphere during summertime for one month to observe rusting.

Evaluation Standards

Excellent: no rusting

Good: very slight rusting (rusted area less than 3% based on surface area of test strip)

Acceptable: slight rusting (rusted area 3% to less than 10% based on surface area of test strip)

Unacceptable: heavy rusting (rusted area 30% or more based on surface area of test strip)

The results of the testing described above are shown in Table 4. As apparent from Table 4, Examples 24 to 57 using the water-based lubricating film treatment agent according to the present invention exhibit excellent lubricity and seizure resistance, and are excellent in corrosion resistance. The ratios of rusting in these Examples were 2% or less in each of the indoor exposure test, the high-temperature lubricating test, the dew condensation test and the indoor exposure test after working, exhibiting good results. On the other hand, Comparative Example 9 is inferior in corrosion resistance because the maleic anhydride of the resin component (A) is not imidated. For Comparative Example 10, the degree of neutralization of the resin component (A) is too low for the component to be dispersed in water, preventing a formulation from being manufactured. Comparative Example 11 does not contain the resin component (A), and therefore, suffers from poor water resistance and corrosion resistance of the lubricating film. Comparative Example 12 does not contain the water-soluble inorganic component (B), with the result that sufficient strength of the lubricating film and film conformability to the metallic material during plastic deformation may not be obtained and both lubricity and seizure resistance are inferior. Comparative Example 13 is inferior in lubricity because it does not contain the solid lubricating component (C). For Comparative Example 14, wherein the phosphate film was treated with a reactive soap, while excellent lubricity is exhibited, effluent treatment and/or fluid management will be required, with the result that convenient process steps or devices may not be used, and waste associated with the reaction will be produced to increase environmental burden.

TABLE 1

| | Resin components (A) | Amounts added (%) | Inorganic reinforcing components ($B_1$) | Amounts added (%) | Solid lubricating components (C) | Amounts added (%) | Rust-preventive additive components (D) | Amounts added (%) | Surface active agents (%) | Total (%) | (A) + (B) | (A)/(B) |
|---|---|---|---|---|---|---|---|---|---|---|---|---|
| Example 1 | (A)-1 | 35 | (B1)-3 | 5 | (C)-2 | 30 | | | | 100 | 70 | 1.00 |
| | | | (B1)-5 | 30 | | | | | | | | |
| Example 2 | (A)-2 | 35 | (B1)-3 | 5 | (C)-2 | 30 | | | | 100 | 70 | 1.00 |
| | | | (B1)-5 | 30 | | | | | | | | |
| Example 3 | (A)-3 | 35 | (B1)-3 | 5 | (C)-2 | 30 | | | | 100 | 70 | 1.00 |
| | | | (B1)-5 | 30 | | | | | | | | |
| Example 4 | (A)-4 | 35 | (B1)-3 | 5 | (C)-2 | 30 | | | | 100 | 70 | 1.00 |
| | | | (B1)-5 | 30 | | | | | | | | |
| Example 5 | (A)-5 | 35 | (B1)-3 | 5 | (C)-2 | 30 | | | | 100 | 70 | 1.00 |
| | | | (B1)-5 | 30 | | | | | | | | |
| Example 6 | (A)-6 | 35 | (B1)-3 | 5 | (C)-2 | 30 | | | | 100 | 70 | 1.00 |
| | | | (B1)-5 | 30 | | | | | | | | |
| Example 7 | (A)-1 | 30 | (B1)-1 | 30 | (C)-1 | 10 | | | | 100 | 90 | 0.50 |
| | | | (B1)-5 | 30 | | | | | | | | |
| Example 8 | (A)-2 | 67 | (B1)-4 | 10 | (C)-2 | 10 | | | | 100 | 90 | 2.91 |
| | | | (B1)-5 | 13 | | | | | | | | |
| Example 9 | (A)-4 | 25 | (B1)-3 | 72 | (C)-1 | 2 | | | | 100 | 97 | 0.35 |
| | | | | | (C)-4 | 1 | | | | | | |
| Example 10 | (A)-4 | 77 | (B1)-4 | 10 | (C)-1 | 2 | | | | 100 | 97 | 3.85 |
| | | | (B1)-5 | 10 | (C)-4 | 1 | | | | | | |
| Example 11 | (A)-1 | 17 | (B1)-3 | 8 | (C)-2 | 5 | | | 1 | 100 | 50 | 0.52 |
| | | | (B1)-5 | 25 | (C)-5 | 44 | | | | | | |
| Example 12 | (A)-1 | 37 | (B1)-3 | 13 | (C)-2 | 5 | | | 1 | 100 | 50 | 2.85 |
| | | | | | (C)-5 | 44 | | | | | | |
| Example 13 | (A)-2 | 6 | (B1)-3 | 14 | (C)-2 | 5 | | | 1 | 100 | 20 | 0.43 |
| | | | | | (C)-5 | 74 | | | | | | |
| Example 14 | (A)-2 | 15 | (B1)-3 | 5 | (C)-5 | 79 | | | 1 | 100 | 20 | 3.00 |
| Example 15 | (A)-6 | 35 | (B1)-3 | 5 | (C)-2 | 25 | (D1)-1 | 5 | | 100 | 70 | 1.00 |
| | | | (B1)-5 | 30 | | | | | | | | |
| Example 16 | (A)-6 | 35 | (B1)-3 | 5 | (C)-2 | 25 | (D1)-2 | 5 | | 100 | 70 | 1.00 |
| | | | (B1)-5 | 30 | | | | | | | | |
| Example 17 | (A)-6 | 35 | (B1)-3 | 5 | (C)-2 | 25 | (D1)-3 | 5 | | 100 | 70 | 1.00 |
| | | | (B1)-5 | 30 | | | | | | | | |
| Example 18 | (A)-1 | 35 | (B1)-10 | 35 | (C)-2 | 30 | | | | 100 | 70 | 1.00 |
| Example 19 | (A)-2 | 35 | (B1)-2 | 5 | (C)-2 | 30 | | | | 100 | 70 | 1.00 |
| | | | (B1)-4 | 30 | | | | | | | | |
| Example 20 | (A)-2 | 35 | (B1)-6 | 5 | (C)-2 | 20 | | | | 100 | 70 | 1.00 |
| | | | (B1)-7 | 30 | (C)-3 | 10 | | | | | | |

TABLE 1-continued

| | Resin components (A) | Amounts added (%) | Inorganic reinforcing components ($B_1$) | Amounts added (%) | Solid lubricating components (C) | Amounts added (%) | Rust-preventive additive components (D) | Amounts added (%) | Surface active agents (%) | Total (%) | (A) + (B) | (A)/(B) |
|---|---|---|---|---|---|---|---|---|---|---|---|---|
| Example 21 | (A)-2 | 35 | (B1)-8 | 5 | (C)-2 | 20 | | | | 100 | 70 | 1.00 |
| | | | (B1)-9 | 30 | (C)-6 | 10 | | | | | | |
| Example 22 | (A)-1 | 37 | (B1)-3 | 13 | (C)-7 | 44 | | | 1 | 100 | 50 | 2.85 |
| | | | | | (C)-8 | 5 | | | | | | |
| Example 23 | (A)-1 | 35 | (B1)-3 | 5 | (C)-9 | 15 | | | | 100 | 70 | 1.00 |
| | | | (B1)-5 | 30 | (C)-10 | 15 | | | | | | |
| Comparative Example 1 | (A)-7 | 35 | (B1)-3 | 5 | (C)-2 | 30 | | | | 100 | 70 | 1.00 |
| | | | (B1)-5 | 30 | | | | | | | | |
| Comparative Example 2 | (A)-8 | | | | | | | | | | | |
| Comparative Example 3 | | | (B1)-1 | 25 | (C)-2 | 50 | | | | 100 | 50 | 0.00 |
| | | | (B1)-5 | 25 | | | | | | | | |
| Comparative Example 4 | (A)-1 | 50 | | | (C)-2 | 50 | | | | 100 | 50 | ////// |
| Comparative Example 5 | (A)-2 | 50 | (B1)-1 | 25 | | | | | | 100 | 100 | 1.00 |
| | | | (B1)-5 | 25 | | | | | | | | |
| Comparative Example 6 | Sodiumtetraborate: 70% | | | | (C)-1 | 30 | | | | 100 | — | — |
| Comparative Example 7 | Water-based urethane resin: 70% | | | | (C)-2 | 30 | | | | 100 | — | — |
| Comparative Example 8 | Phosphate/soap treatment | | | | | | | | | — | — | — |

*Amounts added (%) in Table 1 represent % by mass of each component as a solid based on the total solid content of the water-based lubricant.

TABLE 2

| | Cold forging test | | | | Exposure test |
|---|---|---|---|---|---|
| | Spike values measured | Lubricity | Seizure resistance | Film removal | Corrosion resistance |
| Example 1 | 0.955 | ● | ○ | ○ | ○ |
| Example 2 | 0.952 | ● | ○ | ○ | ○ |
| Example 3 | 0.953 | ● | ○ | ○ | ○ |
| Example 4 | 0.949 | ○ | Δ | ○ | ○ |
| Example 5 | 0.945 | ○ | Δ | ○ | ○ |
| Example 6 | 0.951 | ● | ○ | ○ | Δ |
| Example 7 | 0.950 | ● | ○ | ○ | ○ |
| Example 8 | 0.950 | ● | ○ | ○ | ○ |
| Example 9 | 0.938 | Δ | ○ | ○ | Δ |
| Example 10 | 0.935 | Δ | ○ | ○ | Δ |
| Example 11 | 0.952 | ● | ○ | ○ | ○ |
| Example 12 | 0.953 | ● | ○ | ○ | ○ |
| Example 13 | 0.935 | Δ | Δ | ○ | Δ |
| Example 14 | 0.936 | Δ | Δ | ○ | ○ |
| Example 15 | 0.950 | ● | ○ | ○ | ○ |
| Example 16 | 0.951 | ● | ○ | ○ | ○ |
| Example 17 | 0.950 | ● | ○ | ○ | ○ |
| Example 18 | 0.942 | ○ | Δ | ○ | ○ |
| Example 19 | 0.945 | ○ | ○ | ○ | ● |
| Example 20 | 0.950 | ● | ○ | ○ | ● |

TABLE 2-continued

| | Cold forging test | | | | Exposure test |
|---|---|---|---|---|---|
| | Spike values measured | Lubricity | Seizure resistance | Film removal | Corrosion resistance |
| Example 21 | 0.948 | ○ | ○ | ○ | ● |
| Example 22 | 0.943 | ○ | ○ | ○ | ○ |
| Example 23 | 0.941 | ○ | ○ | ○ | ○ |
| Comparative Example 1 | 0.942 | ○ | Δ | ○ | X |
| Comparative Example 2 | | | | | |
| Comparative Example 3 | 0.895 | X | X | Δ | X |
| Comparative Example 4 | 0.890 | X | X | ○ | ○ |
| Comparative Example 5 | 0.801 | X | Δ | ○ | ○ |
| Comparative Example 6 | | X | X | ○ | X |
| Comparative Example 7 | | Δ | X | X | Δ |
| Comparative Example 8 | | ○ | ○ | X | ○ |

TABLE 3

| | Resin components (A) | Amounts added (% by mass) | Water-soluble inorganic components (B2) | Amounts added (% by mass) | Solid lubricating components (C) | Amounts added (% by mass) | Rust-preventive additive components (D) | Amounts Added (% by mass) | Surface active agents (% by mass) | Total (% by mass) | (A) + (B) | (A)/(B) |
|---|---|---|---|---|---|---|---|---|---|---|---|---|
| Example 24 | (A)-1 | 50 | (B2)-2 | 30 | (C)-2 | 20 | | | | 100 | 80 | 1.67 |
| Example 25 | (A)-2 | 50 | (B2)-2 | 30 | (C)-2 | 20 | | | | 100 | 80 | 1.67 |
| Example 26 | (A)-3 | 50 | (B2)-2 | 30 | (C)-2 | 20 | | | | 100 | 80 | 1.67 |
| Example 27 | (A)-4 | 50 | (B2)-2 | 30 | (C)-2 | 20 | | | | 100 | 80 | 1.67 |
| Example 28 | (A)-5 | 50 | (B2)-2 | 30 | (C)-2 | 20 | | | | 100 | 80 | 1.67 |
| Example 29 | (A)-6 | 50 | (B2)-2 | 30 | (C)-2 | 20 | | | | 100 | 80 | 1.67 |
| Example 30 | (A)-1 | 25.7 | (B2)-1 | 64.3 | (C)-1 | 10 | | | | 100 | 90 | 0.40 |
| Example 31 | (A)-2 | 77.1 | (B2)-3 | 12.9 | (C)-2 | 10 | | | | 100 | 90 | 5.98 |
| Example 32 | (A)-4 | 16.2 | (B2)-2 | 80.8 | (C)-1 | 2 | | | | 100 | 97 | 0.20 |

TABLE 3-continued

| | Resin components (A) | Amounts added (% by mass) | Water-soluble inorganic components (B2) | Amounts added (% by mass) | Solid lubricating components (C) | Amounts added (% by mass) | Rust-preventive additive components (D) | Amounts Added (% by mass) | Surface active agents (% by mass) | Total (% by mass) | (A) + (B) | (A)/(B) |
|---|---|---|---|---|---|---|---|---|---|---|---|---|
| | | | | | (C)-4 | 1 | | | | | | |
| Example 33 | (A)-4 | 86.2 | (B2)-4 | 10.8 | (C)-1 | 2 | | | | 100 | 97 | 7.98 |
| | | | | | (C)-4 | 1 | | | | | | |
| Example 34 | (A)-1 | 15 | (B2)-5 | 35 | (C)-2 | 5 | | | 1 | 100 | 50 | 0.43 |
| | | | | | (C)-5 | 44 | | | | | | |
| Example 35 | (A)-1 | 42.8 | (B2)-6 | 7.2 | (C)-2 | 5 | | | 1 | 100 | 50 | 5.94 |
| | | | | | (C)-5 | 44 | | | | | | |
| Example 36 | (A)-2 | 4 | (B2)-7 | 16 | (C)-2 | 5 | | | | 100 | 20 | 0.25 |
| | | | | | (C)-5 | 74 | | | | | | |
| Example 37 | (A)-2 | 17.7 | (B2)-8 | 2.3 | (C)-5 | 79 | | | | 100 | 20 | 7.70 |
| Example 38 | (A)-1 | 45 | (B2)-1 | 30 | (C)-2 | 20 | (D2)-1 | 5 | | 100 | 75 | 1.50 |
| Example 39 | (A)-1 | 45 | (B2)-2 | 30 | (C)-2 | 20 | (D2)-2 | 5 | | 100 | 75 | 1.50 |
| Example 40 | (A)-1 | 45 | (B2)-3 | 30 | (C)-2 | 20 | (D2)-3 | 5 | | 100 | 75 | 1.50 |
| Example 41 | (A)-1 | 45 | (B2)-4 | 30 | (C)-2 | 20 | (D2)-4 | 5 | | 100 | 75 | 1.50 |
| Example 42 | (A)-1 | 45 | (B2)-5 | 30 | (C)-2 | 20 | (D2)-5 | 5 | | 100 | 75 | 1.50 |
| Example 43 | (A)-1 | 45 | (B2)-6 | 30 | (C)-2 | 20 | (D2)-1 | 3 | | 100 | 75 | 1.50 |
| | | | | | | | (D2)-5 | 2 | | | | |
| Example 44 | (A)-1 | 45 | (B2)-7 | 30 | (C)-2 | 20 | (D2)-2 | 3 | | 100 | 75 | 1.50 |
| | | | | | | | (D2)-5 | 2 | | | | |
| Example 45 | (A)-1 | 45 | (B2)-8 | 30 | (C)-2 | 20 | (D2)-3 | 3 | | 100 | 75 | 1.50 |
| | | | | | | | (D2)-6 | 2 | | | | |
| Example 46 | (A)-1 | 45 | (B2)-9 | 30 | (C)-2 | 20 | (D2)-4 | 3 | | 100 | 75 | 1.50 |
| | | | | | | | (D2)-7 | 2 | | | | |
| Example 47 | (A)-1 | 40 | (B2)-10 | 30 | (C)-2 | 20 | (D2)-1 | 10 | | 100 | 70 | 1.33 |
| Example 48 | (A)-1 | 40 | (B2)-10 | 30 | (C)-2 | 20 | (D2)-8 | 10 | | 100 | 70 | 1.33 |
| Example 49 | (A)-1 | 40 | (B2)-10 | 30 | (C)-2 | 20 | (D2)-9 | 10 | | 100 | 70 | 1.33 |
| Example 50 | (A)-2 | 30 | (B2)-7 | 45 | (C)-2 | 20 | (D2)-1 | 5 | | 100 | 75 | 0.67 |
| Example 51 | (A)-2 | 30 | (B2)-8 | 45 | (C)-2 | 20 | (D2)-2 | 5 | | 100 | 75 | 0.67 |
| Example 52 | (A)-2 | 30 | (B2)-9 | 45 | (C)-2 | 20 | (D2)-3 | 5 | | 100 | 75 | 0.67 |
| Example 53 | (A)-2 | 30 | (B2)-10 | 45 | (C)-2 | 20 | (D2)-4 | 5 | | 100 | 75 | 0.67 |
| Example 54 | (A)-6 | 50 | (B2)-1 | 30 | (C)-2 | 20 | | | | 100 | 80 | 1.67 |
| | | | | | (C)-3 | 10 | | | | | | |
| Example 55 | (A)-6 | 50 | (B2)-2 | 30 | (C)-2 | 20 | | | | 100 | 80 | 1.67 |
| | | | | | (C)-6 | 10 | | | | | | |
| Example 56 | (A)-6 | 50 | (B2)-3 | 30 | (C)-7 | 44 | | | 1 | 100 | 80 | 1.67 |
| | | | | | (C)-8 | 5 | | | | | | |
| Example 57 | (A)-6 | 50 | (B2)-4 | 30 | (C)-9 | 15 | | | | 100 | 80 | 1.67 |
| | | | | | (C)-10 | 15 | | | | | | |
| Comparative Example 9 | (A)-7 | 50 | (B2)-2 | 30 | (C)-2 | 20 | | | | 100 | 80 | 1.67 |
| Comparative Example 10 | (A)-8 | | | | | | | | | | | |
| Comparative Example 11 | | | (B2)-7 | 50 | (C)-2 | 50 | | | | 100 | 50 | 0.00 |
| Comparative Example 12 | (A)-1 | 50 | | | (C)-2 | 50 | | | | 100 | 50 | ////// |
| Comparative Example 13 | (A)-2 | 50 | (B2)-3 | 50 | | | | | | 100 | 100 | 1.00 |
| Comparative Example 14 | | | | Phosphate/soap treatment | | | | | | — | — | — |

※ Amounts added (%) in Table represent % by mass of each component as a solid based on the total solid content of the water-based lubricant.

TABLE 4

| | Cold forging test | | | Corrosion resistance test | | | | | | | |
|---|---|---|---|---|---|---|---|---|---|---|---|
| | | | | Indoor exposure test | | High-temperature humidity cabinet test | | Dew condensation test | | Indoor exposure test after working | |
| | Spike values measured | Lubricity | Seizure resistance | Ratios of rusting | Evaluations | Ratios of rusting | Evaluations | Ratios of rusting | Evaluations | Ratios of rusting | Evaluations |
| Example 24 | 0.955 | Excellent | Excellent | 2% | Good | 2% | Good | 2% | Good | 2% | Good |
| Example 25 | 0.952 | Excellent | Excellent | 2% | Good | 2% | Good | 2% | Good | 2% | Good |
| Example 26 | 0.953 | Excellent | Excellent | 1% | Good | 1% | Good | 2% | Good | 1% | Good |
| Example 27 | 0.950 | Excellent | Excellent | 2% | Good | 2% | Good | 2% | Good | 2% | Good |
| Example 28 | 0.942 | Good | Acceptable | 2% | Good | 2% | Good | 2% | Good | 2% | Good |
| Example 29 | 0.951 | Excellent | Excellent | 2% | Good | 2% | Good | 2% | Good | 2% | Good |
| Example 30 | 0.950 | Excellent | Excellent | 2% | Good | 2% | Good | 2% | Good | 2% | Good |
| Example 31 | 0.952 | Excellent | Excellent | 1% | Good | 1% | Good | 2% | Good | 1% | Good |

TABLE 4-continued

| | Cold forging test | | | Corrosion resistance test: Indoor exposure test | | High-temperature humidity cabinet test | | Dew condensation test | | Indoor exposure test after working | |
|---|---|---|---|---|---|---|---|---|---|---|---|
| | Spike values measured | Lubricity | Seizure resistance | Ratios of rusting | Evaluations | Ratios of rusting | Evaluations | Ratios of rusting | Evaluations | Ratios of rusting | Evaluations |
| Example 32 | 0.935 | Acceptable | Excellent | 2% | Good | 2% | Good | 2% | Good | 2% | Good |
| Example 33 | 0.931 | Acceptable | Excellent | 1% | Good | 1% | Good | 1% | Good | 1% | Good |
| Example 34 | 0.951 | Excellent | Excellent | 2% | Good | 2% | Good | 2% | Good | 2% | Good |
| Example 35 | 0.953 | Excellent | Excellent | 1% | Good | 1% | Good | 1% | Good | 1% | Good |
| Example 36 | 0.942 | Good | Acceptable | 2% | Good | 2% | Good | 2% | Good | 2% | Good |
| Example 37 | 0.941 | Good | Acceptable | 2% | Good | 2% | Good | 2% | Good | 2% | Good |
| Example 38 | 0.950 | Excellent | Excellent | 1% | Good | 1% | Good | 1% | Good | 1% | Good |
| Example 39 | 0.952 | Excellent | Excellent | 2% | Good | 2% | Good | 2% | Good | 2% | Good |
| Example 40 | 0.952 | Excellent | Excellent | 1% | Good | 1% | Good | 1% | Good | 1% | Good |
| Example 41 | 0.953 | Excellent | Excellent | 1% | Good | 1% | Good | 1% | Good | 1% | Good |
| Example 42 | 0.951 | Excellent | Excellent | 1% | Good | 1% | Good | 1% | Good | 1% | Good |
| Example 43 | 0.950 | Excellent | Excellent | 1% | Good | 1% | Good | 1% | Good | 1% | Good |
| Example 44 | 0.953 | Excellent | Excellent | 0% | Excellent | 0% | Excellent | 0% | Excellent | 0% | Excellent |
| Example 45 | 0.952 | Excellent | Excellent | 0% | Excellent | 0% | Excellent | 0% | Excellent | 0% | Excellent |
| Example 46 | 0.951 | Excellent | Excellent | 0% | Excellent | 0% | Excellent | 0% | Excellent | 0% | Excellent |
| Example 47 | 0.955 | Excellent | Excellent | 0% | Excellent | 0% | Excellent | 0% | Excellent | 0% | Excellent |
| Example 48 | 0.953 | Excellent | Excellent | 0% | Excellent | 0% | Excellent | 0% | Excellent | 0% | Excellent |
| Example 49 | 0.951 | Excellent | Excellent | 0% | Excellent | 0% | Excellent | 0% | Excellent | 0% | Excellent |
| Example 50 | 0.954 | Excellent | Excellent | 0% | Excellent | 0% | Excellent | 0% | Excellent | 0% | Excellent |
| Example 51 | 0.955 | Excellent | Excellent | 0% | Excellent | 0% | Excellent | 0% | Excellent | 0% | Excellent |
| Example 52 | 0.953 | Excellent | Excellent | 0% | Excellent | 0% | Excellent | 0% | Excellent | 0% | Excellent |
| Example 53 | 0.953 | Excellent | Excellent | 0% | Excellent | 0% | Excellent | 0% | Excellent | 0% | Excellent |
| Example 54 | 0.952 | Excellent | Excellent | 2% | Good | 2% | Good | 2% | Good | 2% | Good |
| Example 55 | 0.953 | Excellent | Excellent | 1% | Good | 1% | Good | 2% | Good | 1% | Good |
| Example 56 | 0.943 | Good | Excellent | 2% | Good | 2% | Good | 2% | Good | 2% | Good |
| Example 57 | 0.941 | Good | Excellent | 2% | Good | 2% | Good | 2% | Good | 2% | Good |
| Comparative Example 9 | 0.942 | Good | Acceptable | ≧30% | Unacceptable | ≧30% | Unacceptable | ≧30% | Unacceptable | ≧30% | Unacceptable |
| Comparative Example 10 | — | — | — | — | — | — | — | — | — | — | — |
| Comparative Example 11 | 0.949 | Good | Excellent | ≧30% | Unacceptable | ≧30% | Unacceptable | ≧30% | Unacceptable | ≧30% | Unacceptable |
| Comparative Example 12 | 0.893 | Unacceptable | Unacceptable | 2% | Good | 2% | Good | 2% | Good | 2% | Good |
| Comparative Example 13 | 0.803 | Unacceptable | Acceptable | 2% | Good | 2% | Good | 2% | Good | 2% | Good |
| Comparative Example 14 | 0.947 | Good | Excellent | 1% | Good | 1% | Good | 1% | Good | 1% | Good |

As apparent from the description above, using the water-based lubricant for plastic working according to the present invention, excellent lubricity and seizure resistance as well as good corrosion resistance with no rusting may be obtained even under high-temperature/high-humidity environments simulating summertime. Furthermore, the removal of lubricating films after working by cleaning agents is also good. Therefore, the value for use in industry is extremely high.

The invention claimed is:

1. A water-based lubricant for plastic working, comprising a resin component containing a copolymer or homopolymer of monomers having an ethylenically unsaturated bond, including at least maleic anhydride (A), an inorganic component (B) comprising insoluble or hardly soluble in water solid particles of inorganic reinforcing component ($B_1$) having a Mohs hardness of 1 to 5 and/or at least one water-soluble inorganic component ($B_2$), and a solid lubricating component (C), wherein maleic anhydride moieties of the resin component (A) are blocked with a nitrogen-containing compound at a blocking ratio of 10 to 80%, and unblocked of maleic anhydride moieties are neutralized with an alkaline component at a degree of neutralization of 40 to 100%.

2. The water-based lubricant for plastic working according to claim 1, wherein the nitrogen-containing compound is ammonia.

3. The water-based lubricant for plastic working according to claim 1, wherein the monomers having an ethylenically unsaturated bond comprise isobutylene and/or styrene.

4. The water-based lubricant for plastic working according to claim 1, wherein a ratio of maleic anhydride to the total monomers is 30 to 70% by mole in the resin component (A).

5. The water-based lubricant for plastic working according to claim 1, wherein the alkaline component of the resin component (A) is at least one selected from sodium hydroxide, potassium hydroxide and ammonia.

6. The water-based lubricant for plastic working according to claim 1, wherein the inorganic component (B) is the inorganic reinforcing component ($B_1$).

7. The water-based lubricant for plastic working according to claim 6, wherein the resin component (A), the inorganic reinforcing component ($B_1$) and the solid lubricating component (C) have a solid mass in the range of:

$$[(A)+(B_1)]/[(A)+(B_1)+(C)]=0.2 \text{ to } 0.97$$

$$(A)/(B_1)=0.35 \text{ to } 3.85.$$

8. The water-based lubricant for plastic working according to claim 6, wherein the inorganic reinforcing component ($B_1$) has a particle size of 0.1 to 10 μm.

9. The water-based lubricant for plastic working according to claim 6, wherein the inorganic reinforcing component ($B_1$) has a particle size of less than 5 μm.

10. The water-based lubricant for plastic working according to claim 6, wherein the inorganic reinforcing component ($B_1$) is at least one selected from the group consisting of basic magnesium carbonate, basic zinc carbonate, magnesium hydroxide, calcium hydroxide, talc, mica, calcium phosphate, zinc phosphate and aluminum dihydrogen tripolyphosphate.

11. The water-based lubricant for plastic working according to claim 1, wherein the inorganic component (B) is the at least one water-soluble inorganic component ($B_2$), said component ($B_2$) being selected from the group consisting of a borate, a silicate, a vanadate, a molybdate and a tungstate.

12. The water-based lubricant for plastic working according to claim 11, wherein the water-soluble inorganic component ($B_2$) is at least one selected from a molybdate and a tungstate.

13. The water-based lubricant for plastic working according to claim 11, wherein the resin component (A), the water-soluble inorganic component ($B_2$) and the solid lubricating component (C) have a solid mass in the range of:

$$[(A)+(B_2)]/[(A)+(B_2)+(C)]=0.2 \text{ to } 0.97$$

$$(A)/(B_2)=0.2 \text{ to } 8.$$

14. The water-based lubricant for plastic working according to claim 1, further containing a rust-preventive additive component (D), whose ratio by mass is 0.01 to 0.1 based on the total solid content.

15. The water-based lubricant for plastic working according to claim 14, wherein the rust-preventive additive component (D) is at least one selected from a nitrite, a phosphate, an amine, an azole, a permanganate, a peroxide, a carbonate, a zirconium compound, a calcium compound, a magnesium compound, a zinc compound and a bismuth compound.

16. The water-based lubricant for plastic working according to claim 1, wherein the solid lubricating component (C) is at least one selected from the group consisting of a wax, polytetrafluoroethylene, a fatty acid and a salt thereof, a fatty amide, molybdenum disulfide, tungsten disulfide, graphite, melamine cyanurate, organically treated synthetic mica, and an amino acid compound having a layered structure.

17. A metallic material, excellent in plastic workability, comprising a surface over which a film is formed by applying and drying the water-based lubricant for plastic working according to claim 1.

18. A water-based lubricant for plastic working, comprising a resin component containing a copolymer or homopolymer of monomers having an ethylenically unsaturated bond, including at least maleic anhydride (A), an inorganic component (B), and a solid lubricating component (C), wherein maleic anhydride moieties of the resin component (A) are blocked with a nitrogen-containing compound at a blocking ratio of 10 to 80%, and unblocked of maleic anhydride moieties are neutralized with an alkaline component at a degree of neutralization of 40 to 100%, and wherein the inorganic component (B) comprises an inorganic reinforcing component ($B_1$); and the resin component (A), the inorganic reinforcing component ($B_1$) and the solid lubricating component (C) have a solid mass in the range of:

$$[(A)+(B_1)]/[(A)+(B_1)+(C)]=0.2 \text{ to } 0.97$$

$$(A)/(B_1)=0.35 \text{ to } 3.85.$$

19. The water-based lubricant for plastic working according to claim 18, wherein the inorganic reinforcing component ($B_1$) has a particle size of 0.1 to 10 μm and has a Mohs hardness of 1 to 5.

20. The water-based lubricant for plastic working according to claim 18, wherein the inorganic reinforcing component ($B_1$) is at least one selected from the group consisting of basic magnesium carbonate, basic zinc carbonate, magnesium hydroxide, calcium hydroxide, talc, mica, calcium phosphate, zinc phosphate and aluminum dihydrogen tripolyphosphate.

21. The water-based lubricant for plastic working according to claim 18, wherein the inorganic component (B) comprises a combination of the inorganic reinforcing component ($B_1$) and at least one water-soluble inorganic component ($B_2$) selected from the group consisting of a borate, a silicate, a vanadate, a molybdate and a tungstate.

22. The water-based lubricant for plastic working according to claim 21, wherein the water-soluble inorganic component ($B_2$) is at least one selected from a molybdate and a tungstate.

* * * * *